US011054181B2

(12) United States Patent
Kim et al.

(10) Patent No.: US 11,054,181 B2
(45) Date of Patent: Jul. 6, 2021

(54) TEMPERATURE-CONTEXT-AWARE-REFRIGERATOR AND METHOD FOR CONTROLLING SAME

(71) Applicant: LG ELECTRONICS INC., Seoul (KR)

(72) Inventors: Sang Oh Kim, Seoul (KR); Cholok Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 181 days.

(21) Appl. No.: 16/308,234

(22) PCT Filed: Jun. 7, 2017

(86) PCT No.: PCT/KR2017/005913
§ 371 (c)(1),
(2) Date: Dec. 7, 2018

(87) PCT Pub. No.: WO2017/213417
PCT Pub. Date: Dec. 14, 2017

(65) Prior Publication Data

US 2019/0264975 A1 Aug. 29, 2019

(30) Foreign Application Priority Data

Jun. 9, 2016 (KR) ..... 10-2016-0071851

(51) Int. Cl.
*F25D 29/00* (2006.01)
*F25D 11/02* (2006.01)
(Continued)

(52) U.S. Cl.
CPC ..... *F25D 29/00* (2013.01); *F25D 11/02* (2013.01); *F25D 19/00* (2013.01); *F25D 23/02* (2013.01);
(Continued)

(58) Field of Classification Search
CPC ..... F25D 29/00; F25D 11/02; F25D 2400/36; F25D 2500/04; F25D 2500/06;
(Continued)

(56) References Cited

U.S. PATENT DOCUMENTS 5,263,332 A 11/1993 Park
6,138,460 A * 10/2000 Lee ..... F25D 17/065 62/89
(Continued)

FOREIGN PATENT DOCUMENTS

EP 2 161 521 3/2010
JP H06-213548 8/1994
(Continued)

OTHER PUBLICATIONS

European Search Report dated Jan. 8, 2020 issued in EP Application No. 17810540.9.
(Continued)

*Primary Examiner* — Nelson J Nieves
(74) *Attorney, Agent, or Firm* — KED & Associates, LLP

(57) ABSTRACT

The present invention relates to a temperature-context-aware refrigerator and a method for controlling the same. A temperature-context-aware refrigerator according to an embodiment of the present invention comprises: a temperature context awareness unit for sensing a temperature of at least one storage compartment, and when the difference between the sensed temperature and a temperature set for the corresponding storage compartment is equal to or greater than a predetermined level, generating load-responsive operation information including a target temperature lower or higher than the set temperature; a temperature control unit for controlling a temperature sensor and the temperature context awareness unit, and performing a load-responsive operation for controlling the temperature of the storage
(Continued)

compartment by using the load-responsive operation information; and a database unit which is required for the temperature context awareness unit to generate the load-responsive operation information.

13 Claims, 14 Drawing Sheets

(51) Int. Cl.
*F25D 23/02* (2006.01)
*F25D 19/00* (2006.01)

(52) U.S. Cl.
CPC ..... *F25D 23/028* (2013.01); *F25D 2400/36* (2013.01); *F25D 2500/04* (2013.01); *F25D 2500/06* (2013.01); *F25D 2600/06* (2013.01); *F25D 2700/02* (2013.01); *F25D 2700/06* (2013.01); *F25D 2700/121* (2013.01); *F25D 2700/16* (2013.01)

(58) Field of Classification Search
CPC ..... F25D 2600/06; F25D 2700/02; F25D 2700/06; F25D 2700/121; F25D 2700/16; F25D 2700/12
See application file for complete search history.

(56) References Cited

U.S. PATENT DOCUMENTS

2007/0113567 A1 5/2007 Ahn et al.
2007/0163290 A1* 7/2007 Shin ..... F25D 17/045 62/408
2008/0066485 A1* 3/2008 Park ..... F25D 29/00 62/441
2009/0243448 A1* 10/2009 Yu ..... F25D 25/025 312/319.5
2013/0025303 A1 1/2013 Yoon et al.
2014/0358287 A1* 12/2014 Lee ..... F25D 29/00 700/275
2015/0033773 A1* 2/2015 Tajima ..... F25D 17/045 62/80
2015/0184923 A1* 7/2015 Jeon ..... F25D 21/08 62/80
2015/0226475 A1* 8/2015 Choi ..... F25D 29/00 62/56
2015/0338135 A1* 11/2015 Satou ..... F25D 17/042 62/228.1
2015/0354860 A1* 12/2015 Kacmaz ..... F25D 21/04 62/196.1
2016/0047595 A1* 2/2016 Williams ..... F25B 49/02 62/62
2016/0161155 A1* 6/2016 Guichard ..... H01L 23/427 62/117
2016/0238308 A1 8/2016 Uchida et al.
2017/0176083 A1* 6/2017 Sul ..... F25B 6/04
2017/0241693 A1* 8/2017 Tajika ..... G07F 9/105
2017/0241701 A1* 8/2017 Lee ..... B01F 3/04106
2017/0314849 A1* 11/2017 Xie ..... B67D 1/0888
2018/0120015 A1* 5/2018 Darka ..... F25D 11/00
2018/0192791 A1* 7/2018 Miller ..... A47F 3/043
2019/0195550 A1* 6/2019 Sakae ..... F25B 13/00
2020/0278238 A1* 9/2020 Lane ..... G01G 19/42

FOREIGN PATENT DOCUMENTS

JP 2007-292421 11/2007
KR 10-2001-0055301 7/2001
KR 10-2007-0054462 5/2007
KR 10-2013-0014080 2/2013
KR 10-2014-0019594 2/2014
WO WO 2015/063855 5/2015

OTHER PUBLICATIONS

International Search Report (with English Translation) and Written Opinion dated Mar. 15, 2018 issued in Application No. PCT/KR2017/005913.

* cited by examiner

TEMPERATURE-CONTEXT-AWARE-REFRIGERATOR AND METHOD FOR CONTROLLING SAME

CROSS-REFERENCE TO RELATED PATENT APPLICATIONS

This application is a U.S. National Stage Application under 35 U.S.C. § 371 of PCT Application No. PCT/KR2017/005913, filed Jun. 7, 2017, which claims priority to Korean Patent Application No. 10-2016-0071851, filed Jun. 9, 2016, whose entire disclosures are hereby incorporated by reference.

TECHNICAL FIELD

The present invention relates to a temperature-context-aware refrigerator and a method for controlling the same.

BACKGROUND ART

A refrigerator, which is an apparatus for maintaining or cooling temperatures of various types of stored goods at a low temperature, includes a storage box composed of one or more separate spaces. The refrigerator has a temperature change interval which can be maintained at a maximum in a process of producing a product and shipping the product, and a user can set temperature of the refrigerator by adjusting the temperature of the refrigerator within the interval.

The user does not easily change the temperature of the refrigerator after setting the temperature of the refrigerator. When the temperature of the refrigerator is fixed, there have been cases where the refrigerator cannot appropriately cope with a sudden temperature change In particular, various kinds of materials are carried into the refrigerator with various temperatures according to their characteristics. When a temperature of an incoming material is excessively high, or a difference in temperature between the incoming material and stored materials which are entirely cooled or frozen is excessively high, the incoming material affects other stored materials in the refrigerator. In this case, there is a problem in that a cooling or freezing performance of the refrigerator cannot be sufficiently exhibited because a temperature controllable range of the refrigerator is limited unless a user changes temperature settings.

DISCLOSURE

Technical Problem

In order to solve the above-described problems, it is an object of this application to provide a method in which a refrigerator controls a temperature thereof in context-aware manner by recognizing a temperature change occurring in a storage space of the refrigerator due to a material carried into the storage space, and a refrigerator using the same.

It is an object of this application to allow a refrigerator to operate out of a range of a preset setup temperature or control temperature so that the refrigerator is flexibly adapted to a temperature change of a storage space of the refrigerator when a sudden increase or decrease in temperature occurs due to a material carried into the storage space.

It is an object of this application to allow a server and a portable device disposed outside to check information on an operation of a refrigerator so that the operation of the refrigerator is controlled or a load response such as rapid cooling or rapid freezing is controlled from outside.

The objects of the present invention are not limited to the above-mentioned objects, and the other objects and the advantages of the present invention which are not mentioned can be understood by the following description, and more clearly understood by the embodiments of the present invention. It will be also readily seen that the objects and the advantages of the present invention may be realized by means indicated in the patent claims and a combination thereof.

Technical Solution

According to one embodiment of the present invention, there is provided a temperature-context-aware refrigerator. The temperature-context-aware refrigerator may include one or more partitioned storage spaces, one or more temperature sensors for sensing a temperature of a first storage space, a temperature context awareness unit for generating first load responsive operation information including a target temperature lower than a first temperature of first temperature information by using the first temperature information set for the first storage space and second temperature information sensed by the temperature sensors, a temperature control unit for controlling the temperature sensors and the temperature context awareness unit, and performing a load responsive operation by using the first load responsive operation information so as to control a temperature of the first storage space, and a database unit required for the temperature context awareness unit to generate the load responsive operation information.

According to another embodiment of the present invention, there is provided a temperature-context-aware refrigerator. The temperature-context-aware refrigerator may include one or more partitioned storage spaces, one or more temperature sensors for sensing temperatures of the storage spaces, a temperature context awareness unit for generating load responsive operation information including a target temperature higher than a first temperature of first temperature information by using the first temperature information set for the storage spaces and second temperature information sensed by the temperature sensors, a temperature control unit for controlling the temperature sensors and the temperature context awareness unit, and performing a load responsive operation by using the load responsive operation information so as to control temperatures of the storage spaces; and a database unit required for the temperature context awareness unit to generate the load responsive operation information. The load responsive operation information may include information to temporarily stop cooling or freezing of the storage spaces or weaken cooling or freezing of the storage spaces.

According to still another embodiment of the present invention, there is provided a portable device. The portable device may include an application storage unit for storing an application that controls a load responsive operation of a refrigerator, a communication unit for transmitting a setup condition set by the application to a server and receiving a message notifying the load responsive operation of the refrigerator from the server, an interface unit for outputting a screen of the application, and a control unit for executing the application and controlling the communication unit and the interface unit. The message may include any one or more of current condition information of the load responsive operation, history information, setup information of the refrigerator to be changed according to the load responsive operation, and carry-in condition information including a temperature condition of a material carried into the refrigerator.

According to still another embodiment of the present invention, there is provided a method for controlling a temperature-context-aware refrigerator. The method may include a step in which a communication unit of a server receives a load responsive operation flag instructing a load responsive operation from a communication unit of the refrigerator, a step in which a control unit of the server stores all or some of a load responsive operation flag of the refrigerator in a database unit of the server, and a step in which the communication unit of the server transmits a message notifying a load responsive operation of the refrigerator to a portable device corresponding to the refrigerator.

Advantageous Effects

When the present invention is applied, a refrigerator may sense a temperature increase or decrease in a storage space of the refrigerator and recognize an increase amount or a decrease amount thereof, thereby controlling temperature thereof in a context-aware manner.

Further, when the present invention is applied, it is possible to control an operation of the refrigerator in response to a condition of the storage space without being limited to a preset setup temperature or control temperature even when a sudden increase or decrease in temperature occurs due to a material carried into the refrigerator.

Furthermore, when the present invention is applied, a server or a portable device disposed outside may check information on the operation of the refrigerator, thereby controlling the operation of the refrigerator or a load response such as rapid cooling or rapid freezing from outside.

Effects of the present invention are not limited the aforementioned effects. Those skilled in the art can easily derive various effects of the present invention from a configuration of the present invention.

MODE FOR INVENTION

Figure 1:
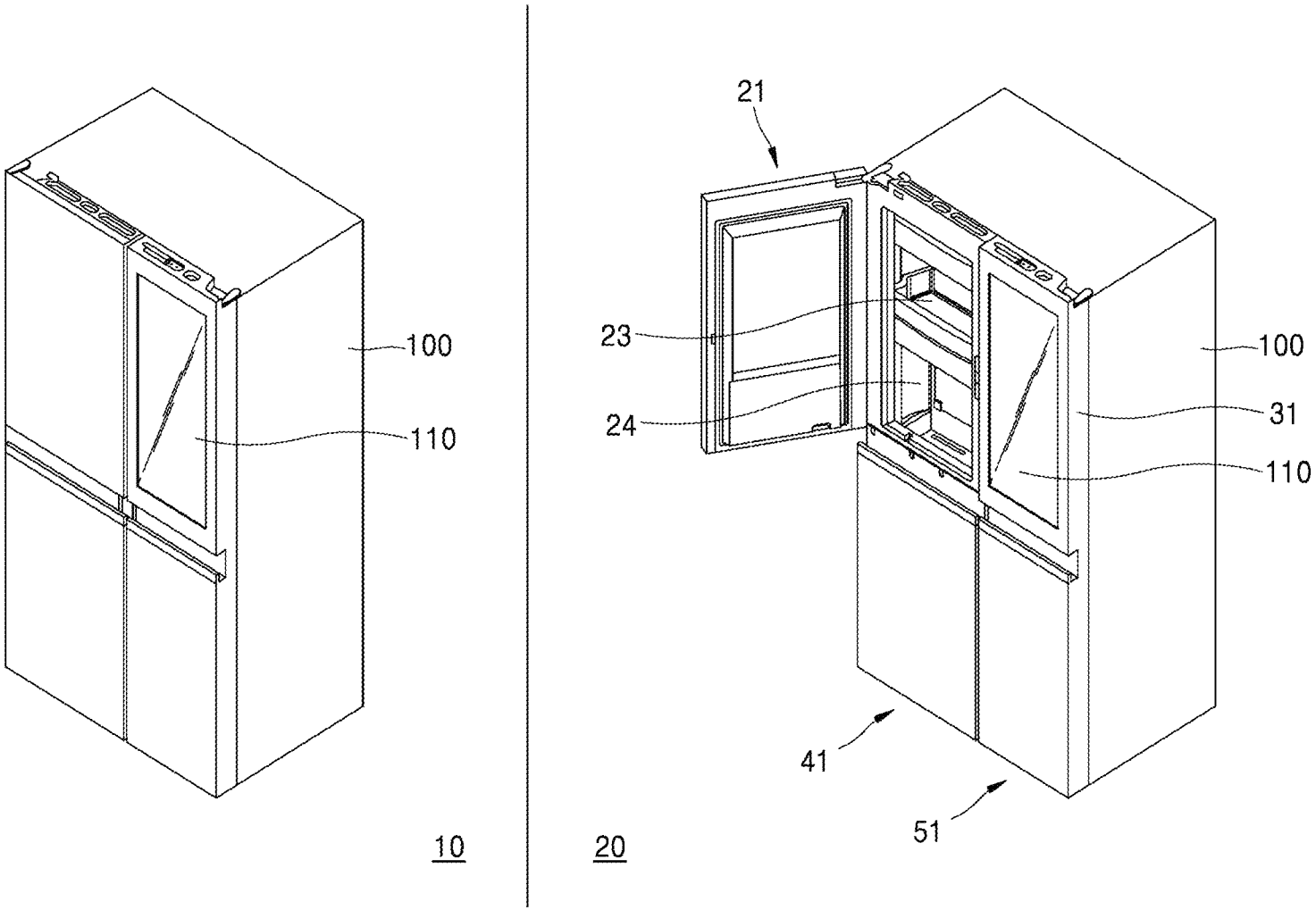
FIG. 1 is a view showing a temperature-context-aware refrigerator according to one embodiment of the present invention.

Hereinafter, embodiments of the present invention will be described in detailed with reference to the accompanying drawings so that those skilled in the art can easily carry out the present invention. The present invention is not limited to the embodiments disclosed herein but may be implemented in various different forms.

In order to clearly describe the embodiments, the description irrelevant to the embodiments has been omitted. Same or like reference numerals designate same or like components throughout the specification. Further, some embodiments will be described in detail with reference to the illustrative drawings. Regarding the reference numerals assigned to the components in the drawings, it should be noted that the same components will be designated by the same reference numerals, wherever possible, even though they are shown in different drawings. Furthermore, in relation to describing the present invention, the detailed description of well-known related configurations or functions can be omitted when it is deemed that such description may cause ambiguous interpretation of the present invention.

Also, in relation to describing components of the present invention, terms such as first, second, A, B, (a), (b) or the like may be used. Each of these terms is not used to define an essence, order, sequence or the number of a relevant component but used merely to distinguish the relevant component from other component(s). It should be noted that, when it is described in the specification that one component is "connected," "coupled" or "joined" to another component, the former may be directly "connected," "coupled," and "joined" to the latter or "connected", "coupled", and "joined" to the latter via another component.

In addition, in relation to implementing the present invention, features of the present invention may be described as being performed by separate components for ease of explanation. However, these features may be implemented by a single device or module or one feature may be implemented by several devices or modules.

In this application, a refrigerator is mainly described as an apparatus for cooling or freezing stored goods. The refrigerator may include various apparatuses configured to mainly perform a cooling and freezing function such as a general refrigerator that stores a food, a kimchi refrigerator, a beverage refrigerator, a household refrigerator, a commercial refrigerator, a freezing apparatus composed of only a freezer, and the like. Also, the refrigerator may be an apparatus configured to cool non-food stored goods such as a cosmetic refrigerator. In addition, a refrigeration apparatus installed in a movable type rather than a stationary type, for example, a large-size refrigerated trailer, may be also included in embodiments referred to herein.

FIG. 1 is a view showing a temperature-context-aware refrigerator according to one embodiment of the present invention. 10 indicates an appearance of a refrigerator 100 in a closed state, and 20 indicates an appearance of the refrigerator 100 in an open state. A space that is opened and closed by one door 21 of a plurality of doors 21, 31, 41 and 51 constituting the refrigerator 100 may be divided into a plurality of storage spaces 23 and 24, and temperatures of the respective storage spaces 23 and 24 may be controlled independently. Of course, with respect to spaces opened and closed by one door, temperatures thereof may be controlled in the same manner.

The refrigerator 100 may further include a display unit 110 for displaying information or an interior of the refrigerator 100. The display unit 110 may be disposed on a front surface of a particular door 31 or a side surface of the refrigerator 100.

In order to control temperature of the refrigerator 100 shown in FIG. 1, a temperature sensor for sensing internal temperature of a storage space and a temperature control unit for controlling temperature of each storage space may be provided. Also, a temperature context awareness unit may be further provided so that a temperature-context-aware refrigerator operates according to one embodiment of the present invention.

Figure 2:
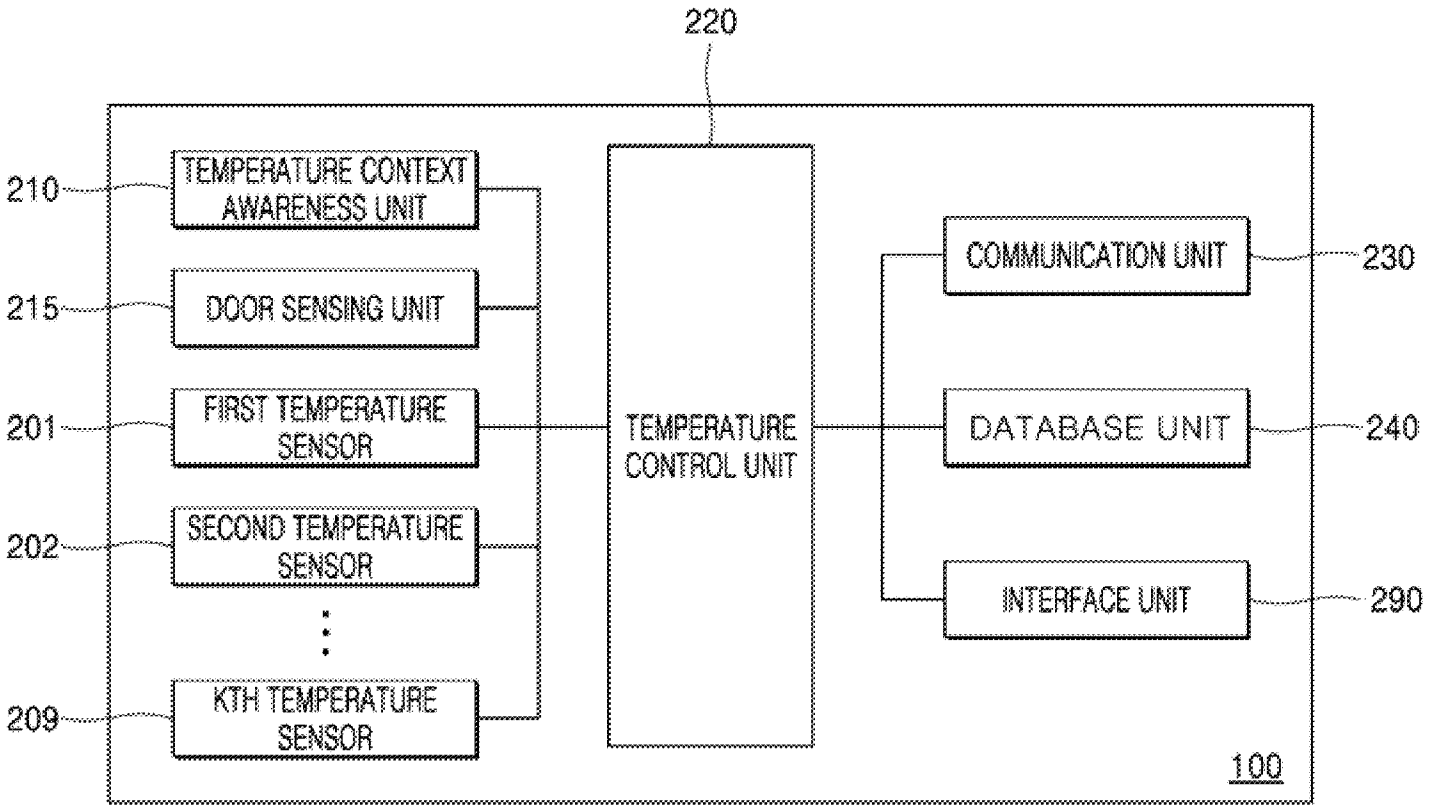
FIG. 2 is a view showing components for controlling the above-described refrigerator 100 to operate in a temperature-context-aware manner.

FIG. 2 is a view showing components for controlling the above-described refrigerator 100 to operate in a temperature-context-aware manner. The components provided in the refrigerator 100 to control an operation of the refrigerator 100 may include one or more temperature sensors 201, 202, . . . , 209 for sensing temperature of each storage space, a temperature context awareness unit 210 for storing a temperature set by a user or a control temperature set at the time of shipping as a reference temperature, recognizing a temperature change based on a difference between the stored temperature and a temperature sensed by the temperature sensors and determining whether or not a load responsive operation is required, and a temperature control unit 220 for controlling the temperature context aware unit 210 and the temperature sensors 201, 202, . . . , 209 and performing a load responsive operation according to predetermined load responsive operation information generated by the temperature context aware unit 210 (temperature context aware unit 210 and temperature control unit 220 may be collectively referred to as a controller).

In one embodiment, a load response is to change control of cooling or freezing for a storage space when a material with very high temperature or a material with extremely low temperature is carried into the storage space. In one embodiment, when a material with high temperature is carried into a cooling storage space of which preset control temperature is 2 degrees, a refrigerator may operate by temporarily setting a target temperature to −2 degrees.

Hereinafter, the present invention is described based on an embodiment in which a high-temperature material is carried in, but the present invention is not limited thereto. For example, a case in which a very low-temperature material is carried in is also applicable. For example, when a −3-degree material is carried into a cooling storage space of which control temperature is 3 degrees, the refrigerator may operate by temporarily increasing a target temperature to 5 degrees, thereby preventing materials stored in the cooling storage space from being unnecessarily frozen.

Also, the refrigerator 100 may further include a communication unit 230 for communicating with an external device (a server disposed outside or a portable device). An embodiment of the external device may be a server (not shown in the drawings) that provides information or logic, programs, and the like required for the temperature context awareness unit 210 of the refrigerator 100 to operate, for example. Another embodiment of the external device may include a server that is disposed outside to provide information, logic, and programs required for the temperature context awareness unit 210 to a plurality of refrigerators or to share a database. Further, the portable device may include a smart phone, a tablet PC, and the like. The portable device may be a device capable of providing information or logic, programs, or the above-described database required for the temperature context awareness unit 210 of the refrigerator 100 to operate, or monitoring an operation condition of the refrigerator 100 (not shown in the drawing).

The database unit 240 may store information, logic, databases, programs, and the like from the above-described external device, or may store an operation result of the refrigerator 100 and provide the operation result to the external device through the communication unit 230.

Also, the refrigerator 100 may further include an interface unit 201 for displaying a current operation condition of the refrigerator 100 and allowing the user to input a particular setup temperature. The interface unit 201 may control characters, images, and the like to be displayed on the display unit 110 of FIG. 1, and may be integrated with the display unit 110 so that information is input through a touch screen of the display unit 110.

An embodiment in which respective components of the above-described refrigerator 100 control temperature in a temperature-context-aware manner will be described.

The above-described storage spaces each may control temperature thereof, and the respective temperature sensors 201, 202, . . . , 209 may sense a temperature of a storage space. The temperature sensors 201, 202, . . . , 209 may sense not only temperature but also humidity. In addition, the temperature sensors 201, 202, . . . , 209 may have a heat sensing function, and thus, may sense a sudden increase in temperature, for example, a high-temperature material carried into a storage space. The temperature sensors each may include any one or more of a heat sensing function for sensing a temperature of a material carried into a storage space and a humidity sensing function for sensing humidity in a first storage space. The heat sensing function may be a function of sensing temperature itself of an incoming material in addition to sensing temperature in a storage space.

In one embodiment of the storage space, a refrigerating compartment and a freezer compartment each may constitute one storage space. In addition, the storage space including a separate temperature sensor and a separate temperature-controllable space, and the refrigerating compartment may include two or more storage spaces. For example, there may be a storage space, such as a fresh room, that is set differently from an average temperature of the refrigerating compartment, and a door may be disposed in the refrigerating compartment to prevent heat transfer between the storage spaces and to achieve spatial separation. This configuration is also applicable to the freezer compartment.

The temperature context awareness unit 210 may recognize respective temperatures of the above-described storage spaces. For the recognition of the temperature, the above-described temperature sensors 201, 202, . . . , 209 may be used. For each storage space, there is preset temperature information. In one embodiment, the temperature control unit 220 may store a setup temperature for each storage space.

The temperature context awareness unit 210 may use first temperature information set for the storage space and second temperature information sensed by the temperature sensor to generate first load responsive operation information including a target temperature lower than a first temperature of the first temperature information. When a high-temperature material is carried into the storage space, such a high temperature material may adversely affect cooled or frozen states of other materials in the storage space. In this case, the temperature context awareness unit 210 may control the temperature of the storage space such as the refrigerating compartment or the freezer compartment to be lower than a preset operation temperature by using the temperature sensor. The temperature control unit 220 may control the temperature sensor and the temperature context awareness unit 210, and may perform a load responsive operation by using the first load responsive operation information so as to control the temperature of the storage space.

A door sensing unit 215 may sense opening and closing of a door. When the door is opened and closed, an object is carried in from outside or taken out to the outside, and the temperature is likely to change in the storage space. Accordingly, the temperature context awareness unit 210 may recognize whether a sudden temperature change has occurred according to opening and closing of the door sensed by the door sensing unit 215. This configuration may prevent a power loss due to the temperature context awareness unit 210 being continuously monitored.

The temperature-context-aware-refrigerator according to the present invention may control the temperature in the storage space according to load responsive operation information generated by the temperature context awareness unit 210 that determines whether or not to perform a load responsive operation even when the temperature is preset. Further, the temperature context awareness unit 210 may continuously update a context awareness database from a portable device such as a server located outside or a smart phone so as to determine whether or not to perform a load responsive operation. In addition, when the refrigerator controls the load responsive operation according to the load responsive operation information generated by the temperature context awareness unit 210, a history of the load responsive operation and a current load responsive operation condition may be provided to the external server or the portable device, or a load responsive operation condition may be displayed through an interface disposed on a door or a side surface of the refrigerator.

Hereinafter, a process in which the temperature context awareness unit 210, the temperature control unit 220, and the communication unit 230 that communicates with the external server and portable device operate when hot food is stored in the storage space or a load responsive operation is required as a result of monitoring the temperature in the storage space independently of a temperature range preset for the refrigerator will be described.

Figure 3:
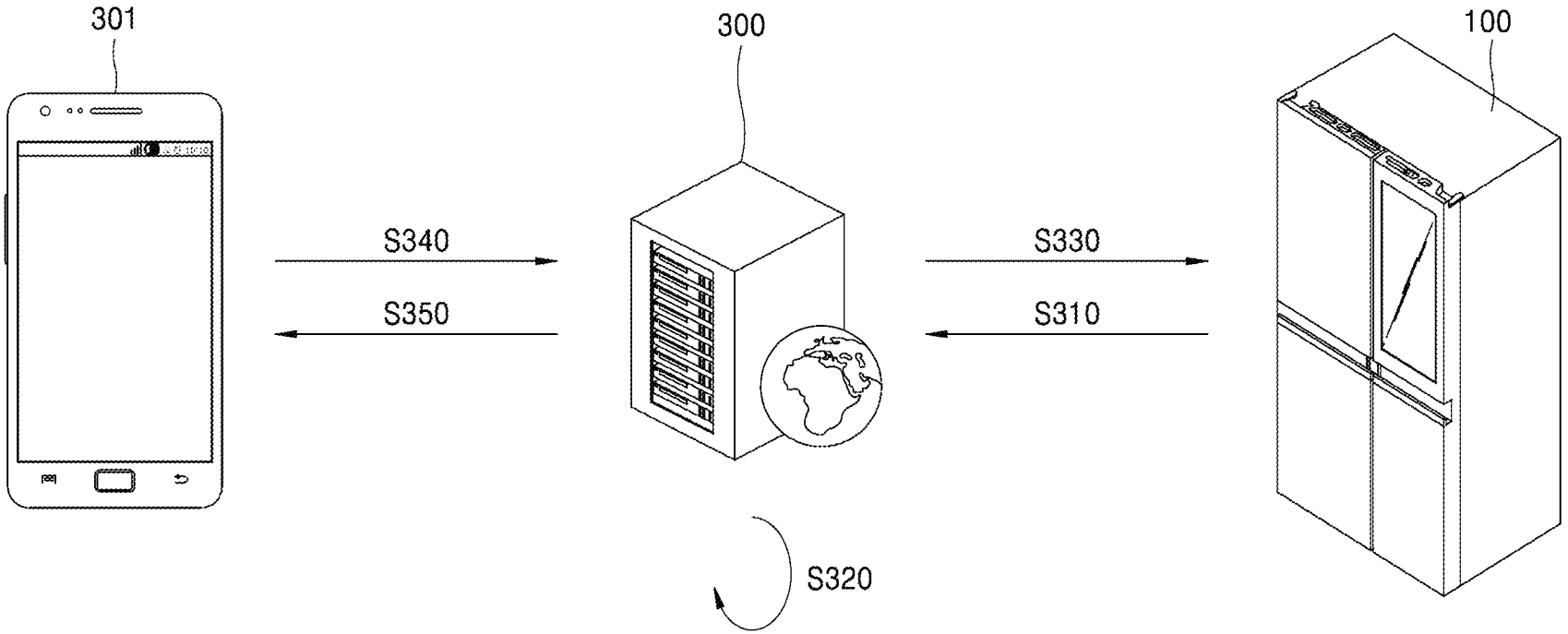
FIG. 3 is a view showing an interaction process between a refrigerator, a server, and a portable device according to one embodiment of the present invention.

FIG. 3 is a view showing an interaction process between a refrigerator, a server, and a portable device according to one embodiment of the present invention.

The server 300 may be connected to a plurality of refrigerators to provide information to the refrigerators, and to receive information on operation states of the refrigerators. The received information may be transmitted to a portable device 301. The portable device 301 may be a smart phone, a tablet, a computer, a notebook, and the like of users of a particular refrigerator. An operation process thereof is as follows.

Referring to FIGS. 2 and 3, when the temperature context awareness unit 210 of the refrigerator 100 senses the temperature of the storage space and determines that a hot object is carried in, or checks that the temperature inside increases and generates load responsive operation information accordingly, the temperature control unit 220 may perform a load responsive operation so as to control temperature of a particular storage space according to the generated load responsive operation information. The communication unit 230 of the refrigerator 100 may transmit a load responsive operation flag notifying that the load responsive operation is performed at step S310. That is, when a high-temperature object is carried into the refrigerator 100, the refrigerator 100 does not operated at the particular setup temperature (first temperature information, Temp_Setting) for the refrigerator 100, but the temperature context awareness unit 210 and the temperature control unit 220 of the refrigerator 100 may temporarily change the setup temperature by targetting a temperature lower than the setup temperature, so that the refrigerator 100 performs a load responsive operation. Accordingly, the temperature control unit 220 may generate a load responsive operation flag thereon, and the communication unit 230 of the refrigerator 100 may transmit the generated load responsive operation flag to the server 300.

The load responsive operation flag may include identification information (ID) of a relevant refrigerator, identification information for the storage space in which the relevant refrigerator performs a load responsive operation (ID of the storage space), and detailed information on the load responsive operation such as a currently sensed temperature and a target temperature, or time required to reach the target temperature. The load responsive operation flag may be selectively transmitted to the server 300 disposed outside. In addition, the load responsive operation flag may be transmitted when the load responsive operation is started, and the load responsive operation flag may be transmitted once again when the load responsive operation is completed. The transmission at the server 300 and the portable device 301 each proceeds at start time point and end point of load responsive operation Furthermore, according to a preset method, a load responsive operation may be completed, and then only a result of performing the load responsive operation may be stored in a load responsive operation flag and the load responsive flag may be transmitted to the server 300.

In summary, the refrigerator 100 may generate a load responsive operation flag including information that a load responsive operation is performed, and transmit the load responsive operation flag to the server 300. In addition, the refrigerator 100 may generate a load responsive operation flag including more detailed information on the load responsive operation and transmit the load responsive operation flag to the server 300.

The transmitted information including detailed information on the load responsive operation such as information that the load responsive operation is performed, information that the load responsive operation is completed, or various information to be recorded in relation to performing the load responsive operation may be stored in a database of the server 300 at step S320. In one embodiment, the stored information may be identification information of the refrigerator, temperature information at a time point when the load responsive operation is performed, identification information of the storage space in which the load responsive operation is performed, an operation additionally required in relation to the load responsive operation, expected operation time or the like.

The server 300 may store information and then transmit a message instructing the refrigerator 100 to change a setup temperature displayed on the display unit 110 (to change the setup temperature to Temp_Target that is a target temperature lower than Temp_Settings that is first temperature information) to the refrigerator 100 at step 330. After receiving the message, the refrigerator 100 may display Temp_Setting as Temp_Target under the control of the interface unit 290 when the current setup temperature is indicated as Temp_Setting. Such a display may be displayed as a character or a symbol on the display unit 110 of FIG. 1. For example, when a setup temperature of the cooling storage space is 2 degrees and a target temperature calculated by the temperature context awareness unit 210 due to the load responsive operation is −2 degrees, the display unit 110 of the refrigerator 100 may change a temperature output display under the control of the interface unit 290 so that the setup temperature of the cooling storage space is displayed as −2 degrees.

In the process of the above-described temperature output display, the interface unit 290 displays a sentence indicating that a load responsive operation is being performed on the display unit 110 so that a user does not determine that the setup temperature of the refrigerator 100 is erroneously set due to a malfunction. For example, a sentence described as "Load responsive operation is being performed" or "Active cooling is being performed" may be output. In another embodiment of the present invention, when the display unit 110 of the refrigerator 100 does not display any information in a power saving mode, the power saving mode may be stopped and the above-mentioned sentence and target temperature may be displayed.

In still another embodiment, when the display unit 110 of the refrigerator 100 does not display any information in the power saving mode, it is possible to display information on the previously performed load responsive operation at a time point when the refrigerator 100 exits from the power saving mode, for example, when the door of the refrigerator is opened or the display unit 110 operates. As a possible embodiment, "Load responsive operation was performed for 10 minutes at 3:50 pm" may be output.

Step S330 may be selectively performed. Further, according to one embodiment of the present invention, the temperature control unit 220 of the refrigerator 100 may independently display information on the display unit 110 together with the interface unit 290 without the instruction of the server 300.

According to a request of the portable device at step S340, or according to a predetermined notification cycle, the server 300 may transmit information on the load responsive operation (history or current state, etc.) to the portable device 301 at step S350. The history of the load responsive operation may be information extracted from the above-described load responsive operation flags, such as time at which the load responsive operation is performed, an actual temperature in the storage space where the load responsive operation was performed, or a target temperature applied when the load responsive operation is performed, the number of times the load responsive operations has been performed, and the like. A method in which the portable device 301 displays information will be described later.

It is possible to set an interval for notifying the history or operation state information on the load responsive operation between the server 300 and the portable device 310 independently of the steps S310 to S350. It is possible to request information in real time, or at various intervals such as one day, two days or the like. The server 300 may collect information and transmit the information to the portable device 301 according to a set interval as in the step 350.

Also, a method in which the portable device displays a message and controls settings of a refrigerator may be different according to communication characteristics or interface characteristics of the portable device 301. For example, when a communication method is Wi-Fi, a Wi-Fi connection may be made directly with the refrigerator 100, and a role performed by the server 300 in FIG. 3 may be provided by the portable device 301. In addition, when the communication method is mobile communication, the portable device 301 may receive a load responsive history of the refrigerator 100 at a predetermined time interval, not in real time, according to a data utilization method of the mobile communication. Of course, in another embodiment, even when the mobile communication is used, the portable device 301 may receive information on the operation of the refrigerator 100 in real time, and may set a notification interval and the like in response to the received information.

Therefore, the function provided by the server 300 described with reference to FIG. 3 may be included in the refrigerator 100 or may be included in the portable device 301. In this case, the refrigerator 100 and the portable device 301 may directly communicate with each other without an intermediate device. An embodiment of the detailed interface that may be provided by the portable device 301 will be described with reference to FIGS. 11 to 13.

Figure 4:
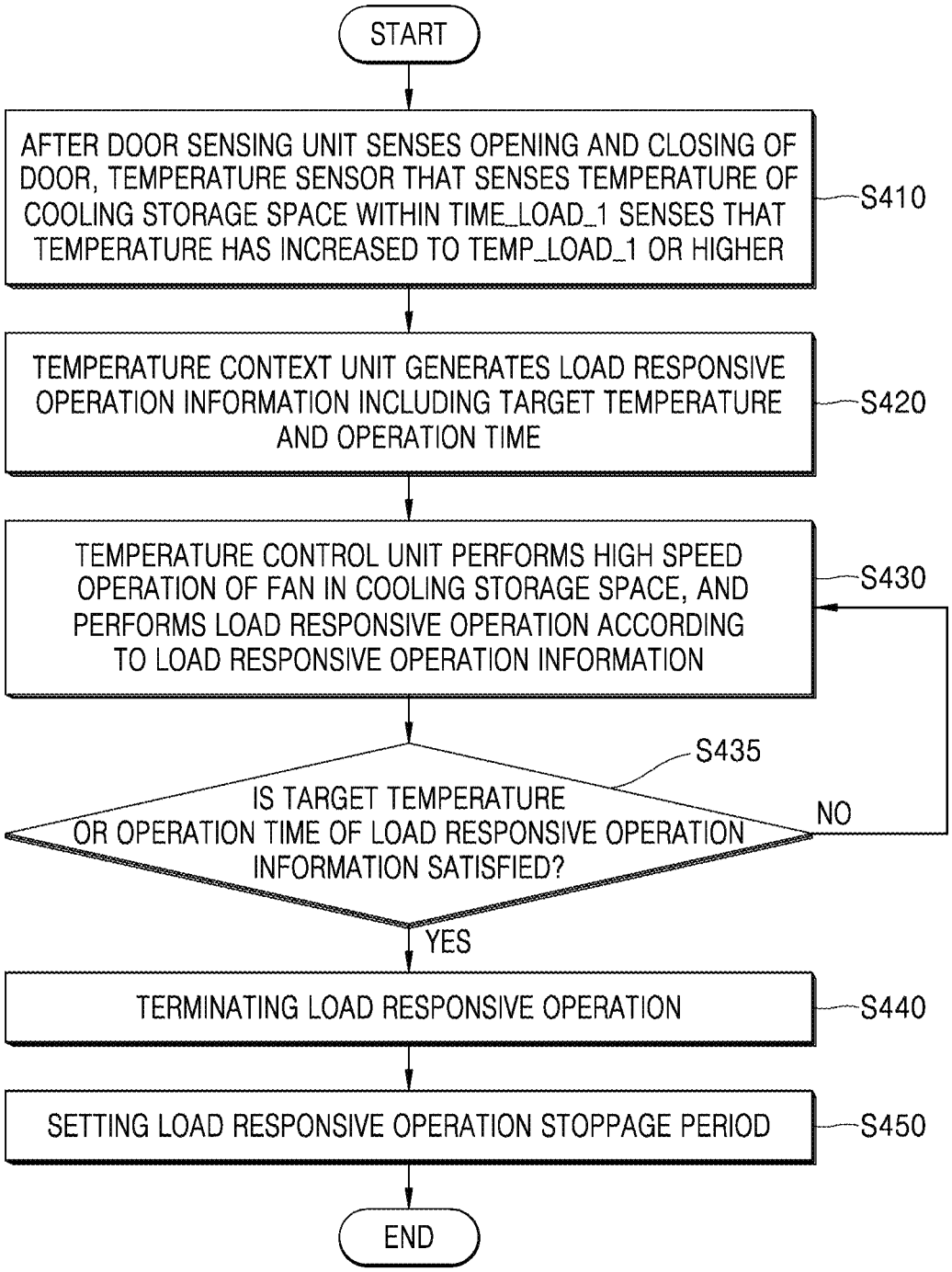
FIG. 4 is a view showing an example of a load responsive operation performed in a cooling storage space according to one embodiment of the present invention.
Figure 5:
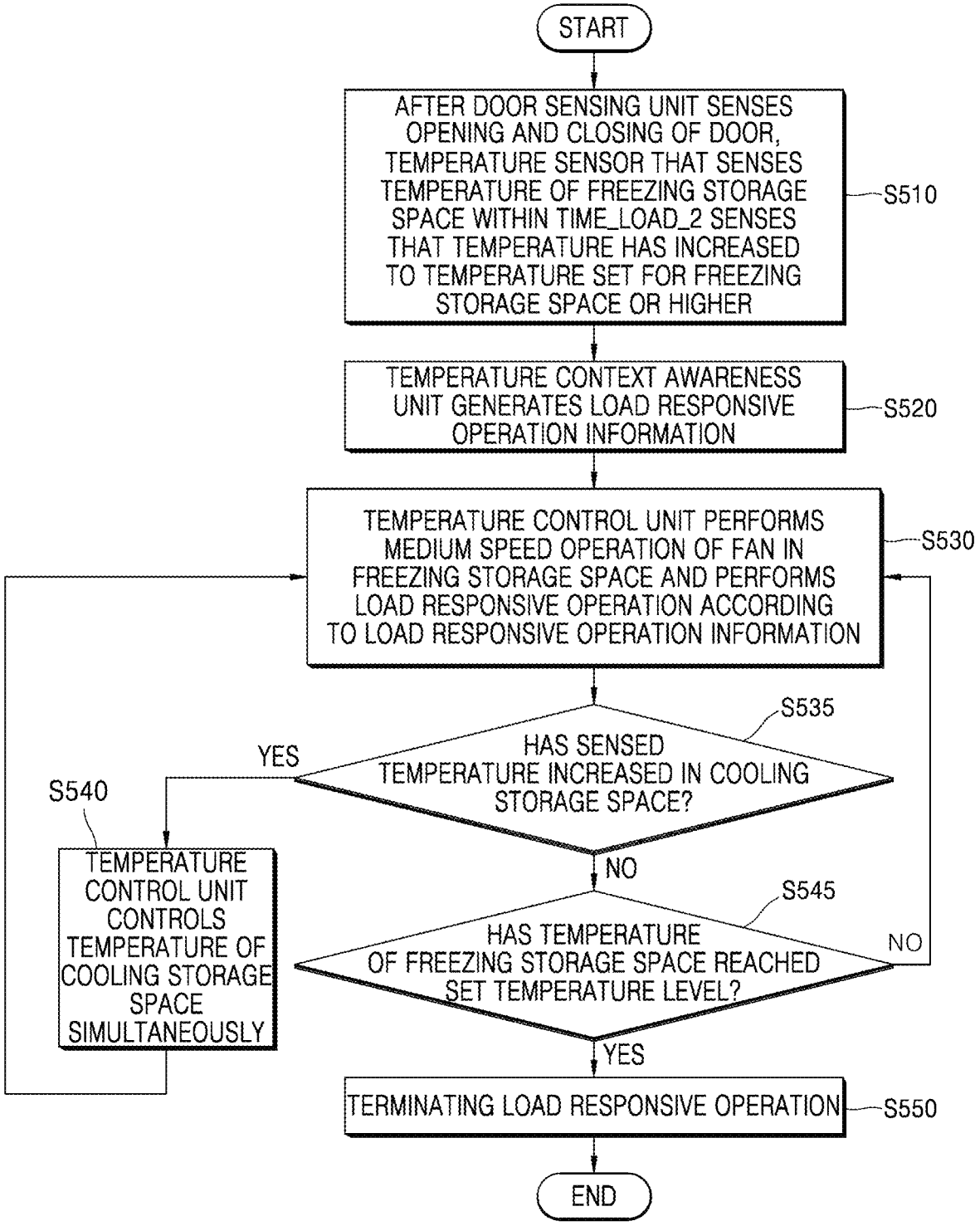
FIG. 5 is a view showing an example of a load responsive operation performed in a freezing storage space according to one embodiment of the present invention.
Figure 6:
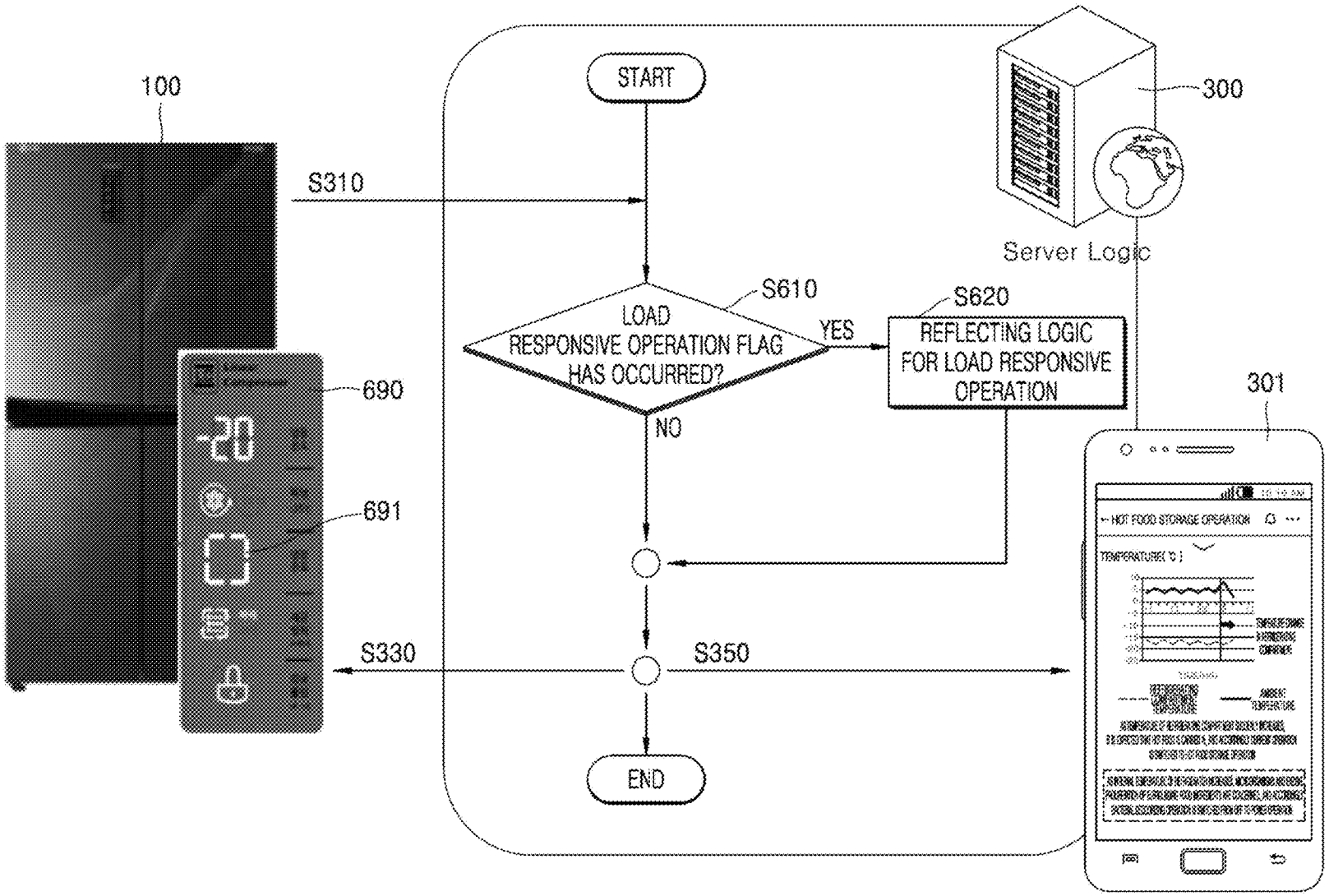
FIG. 6 is a flowchart showing an interaction between a refrigerator, a server, and a portable device according to one embodiment of the present invention.

FIGS. 4 to 6 are views each showing a process in which the temperature context awareness unit 210 of the refrigerator determines a load responsive operation and the temperature control unit 200 performs the load responsive operation according to one embodiment of the present invention. The load responsive operation may be performed differently according to characteristics of each storage space and an internal condition of the storage space such as a temperature increase.

FIG. 4 is a view showing an example of a load responsive operation performed in a cooling storage space according to one embodiment of the present invention.

First, the door sensing unit may sense opening and closing of the door, and then may check a temperature increase in the cooling storage space before a period of time Time_Load_1 elapses. That is, the temperature sensor that senses a temperature of the cooling storage space within the period of time Time_Load_1 after the door sensing unit (215 of FIG. 2) senses opening and closing of the door may sense that the temperature increases to a temperature Temp_Load_1 or higher at step S410. Time_Load_1 and Temp_Load_1 may be predetermined.

The temperature context awareness unit (210 of FIG. 2) may check a condition of the temperature increase, and may generate load responsive operation information including a target temperature and operation time at step S420. The target temperature and operation time may be determined according to a difference in temperature between Temp_Load_1 that is a degree of the sensed temperature increase, and a temperature that is currently set for the storage space. The temperature control unit (220 of FIG. 2) may perform a high-speed operation of a fan in the cooling storage space and perform a load responsive operation according to the load operation information at step S430.

The temperature control unit (220 of FIG. 2) may check whether or not the target temperature or the operation time is satisfied while performing the load responsive operation at step S435. Either one is satisfied, the temperature control unit (220 of FIG. 2) may terminate the load responsive operation at step S440, and the temperature context awareness unit (210 of FIG. 2) may set a load responsive operation stoppage period at step S450. This is to prevent the load responsive operation from being performed for a certain period of time so that the temperature of the storage space does not deviate greatly from the setup temperature of the storage space.

Time_Load_1 and Temp_Load_1 may be determined in various ways. Also, corresponding load responsive operation information may be set in various ways. The load responsive operation information may be stored in the database unit 240 of FIG. 2. See Table 1 below. In Table 1, Time_Load_1, Temp_Load_1, target temperature, operation time, and load responsive operation stoppage period may have a predetermined proportional relationship or an inverse proportion relationship. For example, when the operation time is long in a group in which Time_Load_1 is 3 minutes or 5 minutes, the load responsive operation stoppage period may be increased. Similarly, when the operation time is long even in a group in which Time_Load_1 is 10 minutes or 20 minutes, the load responsive operation stoppage period may be increased. This is because, when the load responsive operation time is long, that the time is performed in different temperature from set temperature for the refrigerator or the space, a difference from an expected power consumption amount according to the temperature set by the user may become large. Thus, the load responsive operation stoppage period may be set to correspond to the operation time.

TABLE 1

| Time_Load_1 | Temp_Load_1 | Target temperature | Operation time | Load responsive operation stoppage period (Reoperation prevention period) |
|---|---|---|---|---|
| 3 Min | +3.0 | −4.0 | 30 Min | 2 Hour |
| 5 Min | +2.0 | −3.0 | 1 Hour | 3 Hour |
| 10 Min | +2.0 | −2.8 | 30 Min | 3 Hour |
| 20 Min | +8.0 | −3.0 | 1 Hour | 6 Hour |

The foregoing times and temperatures may be changed in various ways according to an embodiment. Referring to Table 1 above, whether or not temperature increases after opening and closing the door may be monitored for 20 minutes so that the load responsive operation is performed in response to a temperature increase in a corresponding time zone. In a state in which the load responsive operation is performed, no load responsive operation may be performed longer. For example, when a temperature increase of 8 degrees occurs after 20 minutes has elapsed since the door was opened and closed and the load responsive operation is in progress accordingly, the load responsive operation may be set not to be performed even if another temperature change occurs.

In summary of FIG. 4, when a load responsive condition (Time_Load_1 and Temp_Load_1) is satisfied, a load responsive operation may be performed. During the load responsive operation stoppage period (re-operation prevention period), the load responsive operation may not be performed even when a high-load material is carried in.

Further, when a defrosting operation is required due to a frost generated in the storage space by the load responsive operation performed at high speed, the defrosting operation may be normally performed and the load responsive operation may be continued. Also, whether to include or exclude defrosting operation time in or from the operation time of Table 1 may be determined according to an embodiment.

In addition, in the case of the refrigerating compartment, a load responsive operation may be instructed or not, reflecting environmental and cultural characteristics of a region where the refrigerator is installed. As shown in Table 1, information required for the temperature context awareness unit and the temperature control unit to determine and perform the load responsive operation may be updated in real time or cyclically through the server described with reference to FIG. 3 For example, when the user stops a load responsive operation after performing the load responsive operation, the load responsive operation may be determined not to be suitable for the user, and thus information such as particulars shown in Table 1 required for the load responsive operation may be newly updated.

FIG. 5 is a view showing an example of a load responsive operation performed in a freezing storage space according to one embodiment of the present invention.

First, the door sensing unit may sense opening and closing of the door, and then may check a temperature increase in the freezing storage space before a period of time Time_Load_2 elapses. That is, the temperature sensor that senses a temperature of the freezing storage space within the period of time Time_Load_2 after the door sensing unit (215 of FIG. 2) senses opening and closing of the door may sense that the temperature increases to a temperature set for the freezing storage space or higher at step S510. With respect to the freezing storage space, the temperature context awareness unit (210 of FIG. 2) may determine that the load responsive operation unconditionally needs to be performed when the temperature of the freezing storage space is higher than a temperature originally set for the freezing storage space even after a certain period of time elapses, unlike the cooling storage space. Accordingly, the temperature context awareness unit may generate load responsive operation information at step S520.

Here, the load responsive operation information may be generated so that the load responsive operation is performed until the temperature of the freezing storage space returns to the originally set temperature. Then, the temperature control unit (220 of FIG. 2) may controls a medium speed operation of the fan in the freezing storage space, and may perform the load responsive operation according to the load responsive operation information at step S530. In this process, the temperature control unit (220 of FIG. 2) may check whether or not the sensed temperature of the cooling storage space has increased at step S35. When the temperature has increased, the temperature control unit (220 of FIG. 2) may simultaneously control the temperature of the cooling storage space at step S540. In one embodiment, when the temperature of the cooling storage space increases while the load responsive operation is performed for the freezing storage space, the load responsive operation for the freezing storage space may be converted into a simultaneous operation for the cooling storage space and the freezing storage space. When the temperature of the freezing storage space reaches a temperature level that is set at step S545, the temperature context awareness unit and the temperature control unit may terminate the load responsive operation at step S550.

In summary, when the sensor of the freezing storage space (freezer compartment) senses that the temperature of the freezing storage space is equal to or greater than a freezer compartment control temperature (a temperature set for the freezer compartment) within a certain period of time, e.g., 3 minutes, after the door is opened and closed, the load responsive operation for the freezing storage space may be started. In this case, the fan may be operated at medium speed in the freezing storage space, unlike the cooling storage space. When the temperature of the cooling storage space increases while the load responsive operation is performed for the freezing storage space, it is possible to perform a simultaneous operation for the cooling storage space and the freezing storage space. Even when the simultaneous operation is terminated, the load responsive operation, not a general operation, may be performed for the freezing storage space. Thereafter, when the temperature of the freezer storage space reaches a setup temperature that was originally set, the load responsive operation may be terminated. In the case of simultaneous operation, when the temperatures of the cooling and freezing storage spaces are close to or reach temperatures that was respectively set, the load responsive operation may be terminated.

TABLE 2

| Time_Load_2 | Temp_Load_2 | Operation time |
|---|---|---|
| 3 Min | +1.0 | 30 Min |
| 3 Min | +1.5 | 45 Min |
| 3 Min | +2.0 | 1 Hour |
| 10 Min | +3.0 | 30 Min |

In Table 2, Temp_Load_2 may be selectively given. For example, it is possible to check how much the temperature of the freezing storage space has increased or whether or not the temperature of the freezing storage space deviates from a temperature that was set within 3 minutes after the door is closed so as to apply operation time when the temperature is increased by 1 degree or more and operation time when the temperature is increased by 1.5 degrees differently from each other. In addition, when Temp_Load_2 is not set and the temperature is higher than the setup temperature after 3 minutes, the load responsive operation may be unconditionally performed. In this case, items related to Temp_Load_2 and operation time may not exist, and only one item may be set with respect to Time_Load_2.

FIG. 2 and FIGS. 4 and 5 show a configuration in which a load responsive operation is performed when a rapid temperature increase occurs in the storage space after the door is opened and closed, or when the temperature does not return to a control temperature that is set within a certain period of time. Such a load responsive operation may be performed based on predetermined logic received by the temperature control unit 220 and the temperature context awareness unit 210 provided in the refrigerator through the communication unit 230 and may be performed based on logic pre-provided in the refrigerator. In addition, the refrigerator may transmit only information indicating that an internal temperature has increased after the door is opened and closed to an external device such as the server 300, and then the server 300 may adjust a setup temperature or transmit information instructing the load responsive operation.

The above-described load responsive operation is one embodiment of active cooling in which the operation of the refrigerator is not fixedly performed according to a temperature or time set by the user, but is performed by recognizing various conditions in the storage space. The active cooling may include a suitable operation for a condition of the storage space of the refrigerator although it deviates from the user's set point. In one embodiment, the active cooling may transmit an operation condition or an operation history to the portable device such as a smart phone through the external server 300 so as to transmit the operation condition to a user. The refrigerator 100 to which the active cooling according to the present invention is applied may decrease the temperature thereof within a short period of time so as to improve storage quality of other foods stored in the storage space when a high-temperature material is carried into the storage space.

Also, a sterilizing and deodorizing function may be performed together with the load responsive operation such as the active cooling according to one embodiment of the present invention. This configuration may prevent a change in temperature and a deterioration in quality in the storage space.

FIG. 6 is a flowchart showing an interaction between a refrigerator, a server, and a portable device according to one embodiment of the present invention. The embodiment of FIG. 6 will be described in connection with the embodiment of FIG. 3.

First, when the refrigerator 100 determines that the load responsive operation is required, the communication unit (230 of FIG. 2) of the refrigerator 100 may transmit a load responsive operation flag notifying that the load responsive operation is performed at step S310. The server 300 may check that the load responsive operation flag has occurred at step S610, and accordingly may reflect logic for the load responsive operation at step S620. In one embodiment, reflection of the logic may mean that information required for a subsequent operation of the refrigerator 100 is generated by means of information on conditions (temperature, time and the like) that cause the refrigerator 100 to start the load responsive operation, information such as the setup temperature of the refrigerator 100, and the like. For example, when the setup temperature of the refrigerator 100 is set too high and the load responsive operation frequently occurs accordingly, the server 300 may transmit a message requesting the user to adjust the setup temperature to the portable device 301 or the refrigerator 100. Furthermore, when the load responsive operation frequently occurs even though the setup temperature is appropriately set, the server may provide a guidance message about a usage of the refrigerator, thereby preventing power waste from occurring during use of the refrigerator 100.

In particular, the message output from the portable device 301 may include not only a content indicating that a load responsive operation has occurred, but also a change in the temperature at which the load responsive operation has occurred. That is, it is possible to notify the user that the temperature of the refrigerating compartment is changed from 5 degrees to 9 degrees through a graph displayed on the screen of the portable device 301, and that an operation for decreasing the temperature of the refrigerating compartment is performed through a message described as "As the internal temperature of the refrigerator increases, microorganisms and enzyme proliferation of surrounding food ingredients are concerned, and accordingly a bacterial deodorizing operation is switched from off to power operation." at the bottom of the screen. The graph may allow the user to visually check that the internal temperature of the refrigerator has suddenly increased. The past internal temperature of the refrigerator shown in the graph may utilize history data of the temperature that is checked within a predetermined period of time, such as one day, three days, one week or the like.

After the step S620, the server 300 may transmit a predetermined message and information to the refrigerator 100 and transmit a particular message and information to the portable device 301 such as a smart phone according to the occurrence of the load responsive operation flag. As shown in FIG. 3, the server 300 may transmit a message instructing the refrigerator 100 to change a setup temperature displayed on the display unit 110 (to change the setup temperature to Temp_Target that is a target temperature lower than Temp_Settings that is first temperature information) to the refrigerator 100 at the step 330. In addition, the server 300 may transmit information on the load responsive operation (history or current state, etc.) to the portable device 301 at the step S350.

At the step S330, a partial area 690 of the display unit 110 of the refrigerator 100 may display that a load responsive operation is currently being performed. For example, a area indicated by 691 may display "A" or that a cooling fan is rotating so that the user checks a state of the refrigerator 100. Also, at the step S350, the user may check a condition of the refrigerator 100 from the outside through the information displayed on the portable device 301.

Figure 7:
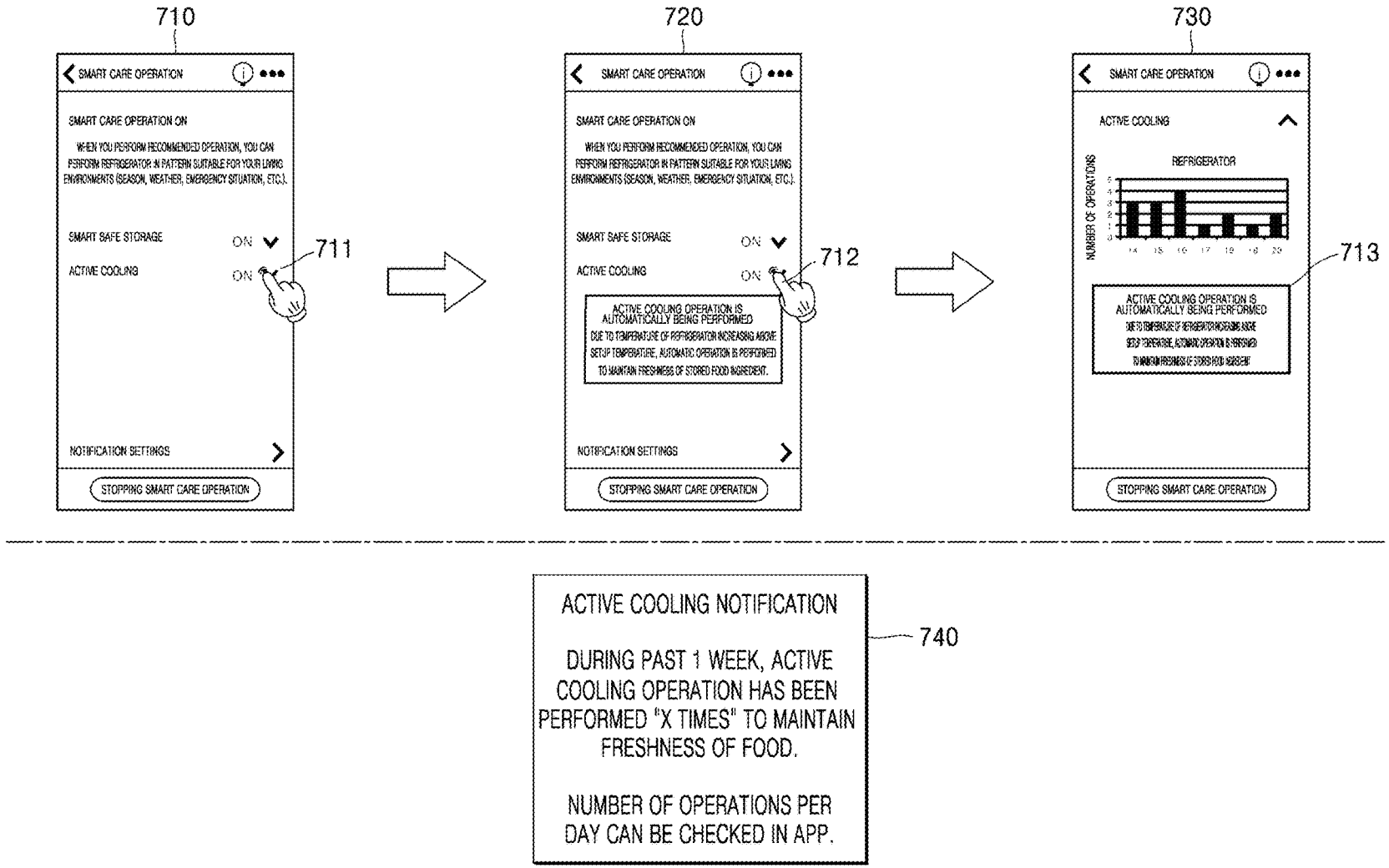
FIG. 7 is a view showing a screen of an application of a portable device for controlling a load responsive operation or checking a load responsive operation state according to one embodiment of the present invention.

FIG. 7 is a view showing a screen of an application of a portable device for controlling a load responsive operation or checking a load responsive operation state according to one embodiment of the present invention. FIG. 7 shows a screen of a smart phone as an embodiment of the portable device.

710 indicates a screen for setting a load responsive operation such as active cooling. As shown in 711, when a portion indicated by active cooling is set as "ON", a refrigerator controlled by a relevant smart phone may be set to perform an active cooling operation. Such an operation may be transmitted to the refrigerator through the server. If there are a lot of refrigerators controlled by the smart phone, whether or not to perform the active cooling operation may be set for each refrigerator.

720 indicates a screen showing a condition of a load responsive operation such as active cooling. As shown in 712, when a portion indicated by active cooling is selected by a touch or the like, "Active cooling is automatically being performed" indicating a state of the refrigerator may be displayed. In more detail, a sentence described as "Due to the temperature of the refrigerator increasing above the setup temperature, an automatic operation is performed to maintain the freshness of the stored food ingredient." may be displayed. Furthermore, in 730, it is possible to check a history of past load responsive operations as shown in 713. 710, 720 and 730 each indicate a screen for monitoring a condition of the refrigerator in real time.

More specifically, 730 may display the number of times the active cooling operation has been performed, that is, the number of active cooling operations, by a particular period, for example, time or date. An increase in the number of times the active cooling operation has been performed may mean that a temperature set for the refrigerator is not suitable for a usage pattern of the refrigerator. That is, since the setup temperature of the refrigerator is set high in comparison to the usage pattern of the refrigerator, an usual load responsive operation may not be performed. In this case, the user may decrease the setup temperature of the refrigerator so as to reduce the number of active cooling operations, so that a temperature of a hot food carried into the refrigerator may be rapidly decreased. Alternatively, the user may change the usage pattern of the refrigerator, thereby implementing an external change such as cooling down the food and then putting it in the refrigerator.

740 shows a result of the server 300 transmitting an active cooling history in a form of a push message. As a result, the user may check a load responsive operation condition of the refrigerator. In addition to 740, the server 300 may also incorporate information indicating that a load responsive operation often occurs due to the currently set control temperature that is too high into the push message. In another embodiment, the server 300 may incorporate information on the internal temperature of the storage space in which the load responsive operation has occurred into the push message to inform the user of a usage habit of storing a high-temperature material in the refrigerator without cooling down, thereby preventing power waste.

The above-described server 300 may monitor an operation condition of the refrigerator, generate logic for the refrigerator, transmit the logic to the refrigerator, and change or update load responsive logic.

That is, when the present invention is applied, a server-mediated operation of the refrigerator may be remotely adjusted or checked by means of the server, the application of the portable device, and a communication function (Wi-Fi, etc.) of the refrigerator. Also, the user may check a state of the refrigerator in real time or cyclically. In this application, the server 300 may retain operation conditiones or operation histories of a plurality of refrigerators, and thus the server 300 may implement an algorithm including logic suitable for the load responsive operation of the refrigerator and provide the same back to the refrigerator.

In one embodiment, the above-described server may include a central server and a regional sever. In another embodiment, the server may include a central server and a device server. For example, the server may include each regional sever that covers the entirety of a particular region and a central server that centrally controls a plurality of regional severs. In still another embodiment, the server may include each device server that covers particular refrigerator models and a central server that centrally controls these device servers.

The following is a summary of a configuration of the refrigerator according to one embodiment of the present invention, which is based on the configuration of FIG. 2 and the embodiments of FIGS. 3 to 7. See FIG. 2.

Among a plurality of storage spaces of the refrigerator, the temperature sensor 201 may sense temperature of a first storage space. The temperature context awareness unit 210 may use first temperature information set for the first storage space and second temperature information sensed by the temperature sensor to generate first load responsive operation information including a target temperature lower than a first temperature of the first temperature information. This configuration may include a case where the temperature sensor senses that the temperature increases to a temperature Temp_Load_1 or higher at the step S410 of the embodiment of FIG. 4 and a case where the temperature sensor senses that the temperature increases to a temperature that is set or higher at the step S510 of the embodiment of FIG. 5.

The temperature control unit 220 may control the temperature sensor and the temperature context awareness unit 210, and may perform a load responsive operation by using the first load responsive operation information so as to control the temperature of the first storage space. In Table 1, the target temperature may mean a temperature that should be lowered in comparison to a set temperature that is set (a first temperature), and the sensed second temperature information may be calculated from Temp_Load_1. The load responsive operation information may include a target temperature, operation time, and the like.

The load responsive operation information may be stored in the database unit 240 and may be transmitted to the external device such as the server 300 in real time or at predetermined intervals. The database unit 240 of the refrigerator may use a kind of file system.

When a high-temperature material carried into the storage space increases the temperature of the storage space and a load responsive operation is performed accordingly, the temperature sensor may monitor the temperature of the first storage space continuously or at predetermined intervals, so that the temperature context awareness unit 210 may determine whether or not to stop the load responsive operation according to the information. For example, even when the load responsive operation is stopped and the operation mode is changed to the original operation mode although the target temperature has not been reached, the temperature of the first storage space may sufficiently become the first temperature.

The information required to stop the load responsive operation shown in Table 1 may be reconstructed as shown in Table 3. A case where Time_Load_1 is 3 minutes and a case where Time_Load_1 is 5 minutes may be constructed as shown in Table 3 below.

TABLE 3

| Time_Load_1 | Temp_Load_1 | Target temperature | Operation time | Stoppage time/ Temperature |
|---|---|---|---|---|
| 3 Min | +3.0 | −4.0 | 30 Min | 15 Min/+1.0 |
| 5 Min | +2.0 | −3.0 | 1 Hour | 20 Min/+1.0 |

In Table 3, when Time_Load_1 is 3 minutes, the temperature sensor may sense that the temperature of the storage space has increased by 3 degrees or more from the first temperature that is set for the storage space after the door is opened and closed, and accordingly load responsive operation information indicating to perform a load responsive operation for 30 minutes so as to reach a target temperature that is 4 degrees below the first temperature may be generated. The temperature sensor may sense the temperature at intervals of 5 minutes while the load responsive operation is being performed. When the internal temperature of the storage space is 1 degree higher than the first temperature after 15 minutes has elapsed since the load responsive operation was performed, the load responsive operation may be stopped, and the refrigerator may be set to perform a general operation. This is because it is possible to sufficiently protect the quality of materials in the storage space even by cooling with the general operation. This configuration is also applicable to the case where Time_Load_1 is 5 minutes.

The communication unit 230 may transmit the above-described first load responsive operation information to the external device by using various communication protocols such as Wi-Fi, 4G mobile communication, etc., and may receive the logic required for the temperature context awareness unit 210 to generate load responsive operation information from the external device. The external device may be the server 300 and may also directly communicate with the portable device 301 without the server.

Also, in a refrigerator including a plurality of storage spaces, a load responsive operation may be performed for each storage space. For example, the temperature control unit 220 may perform a load responsive operation according to the first load responsive operation information for a cooling storage space that is the first storage space. In this process, the temperature context awareness unit 210 may generate second load responsive operation information for a freezing storage space that is a second storage space.

At this time, the temperature control unit 220 may perform a load responsive operation for each storage space, but separately, may perform a load responsive operation including one or all of the first load responsive operation information and the second load responsive operation information. For example, when the first load responsive operation information instructs to perform a load responsive operation for 30 minutes with a target temperature of −3 degrees and the second load responsive operation information instructs to perform a load responsive operation for 1 hour with a target temperature of −15 degrees, a first load responsive operation may be performed according to the first load responsive operation information. After the first load responsive operation is terminated, the second load responsive operation information may be newly updated (to information instructing to perform a load responsive operation for 40 minutes with a target temperature of −13 degrees that is higher than −15 degrees) and a load responsive operation may be performed according to the updated second load responsive operation information.

In one embodiment, when the respective storage spaces are influenced by each other in the cooling or freezing process, one of the load responsive operation information may be first performed. Further, after a new load responsive operation is performed by means of two or more load responsive operation information, a load responsive operation for any one storage space may be terminated. Thereafter, it is possible to newly determine whether or not to perform a load responsive operation.

Figure 8:
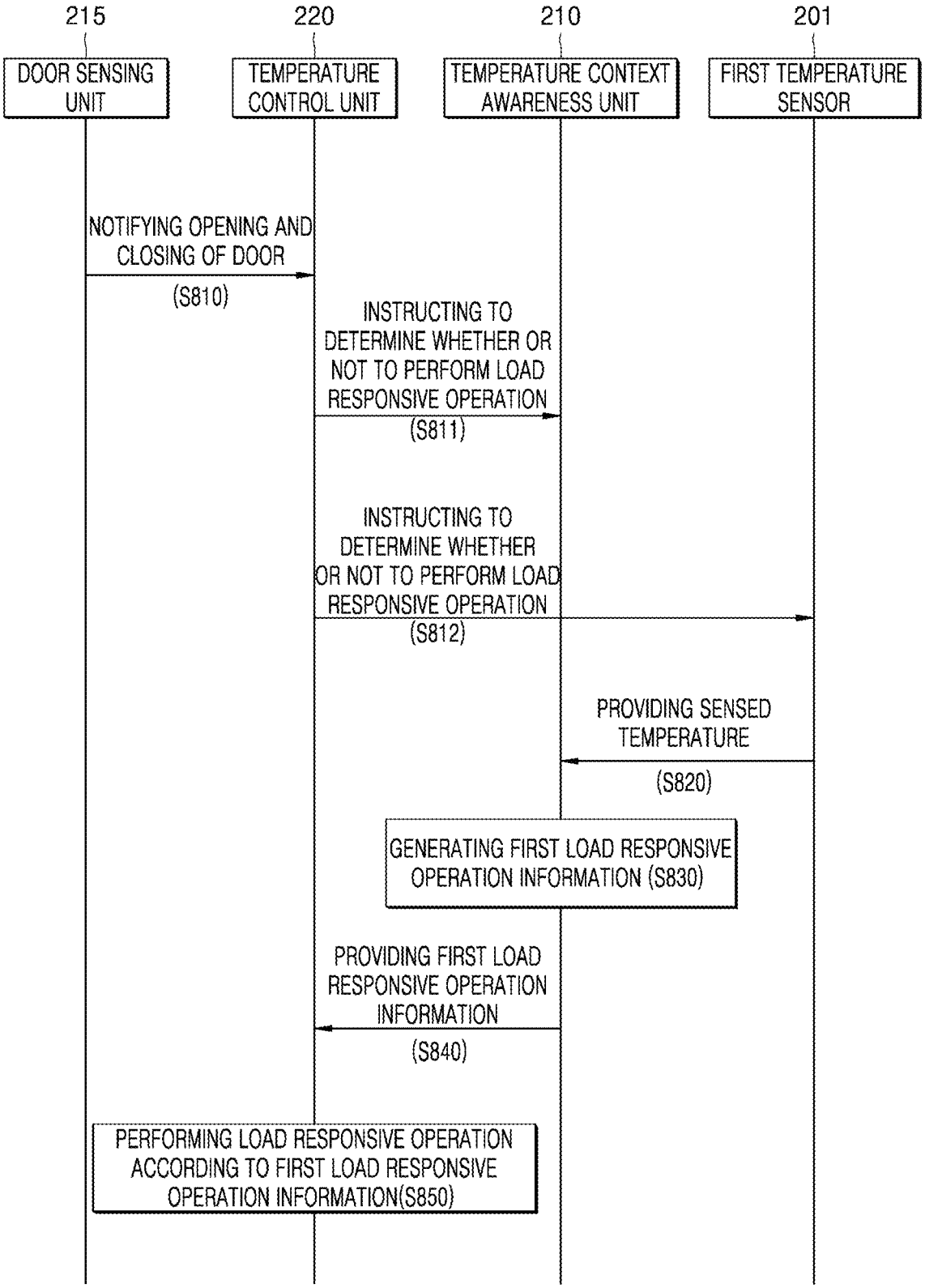
FIG. 8 is a view showing a process in which a load responsive operation is performed between components of a refrigerator according to one embodiment of the present invention.

FIG. 8 is a view showing a process in which a load responsive operation is performed between components of a refrigerator according to one embodiment of the present invention.

The door sensing unit 215 may sense opening and closing of the door of the refrigerator and notify the temperature control unit 220 of the opening and closing of the door at step S810. The temperature control unit 220 may instruct the temperature context awareness unit 210 and the first temperature sensor 201 to determine whether or not to perform a load responsive operation for a first load space according to the opening and closing of the door at steps S811 and S812. The first temperature sensor 201 may sense a temperature at predetermined intervals and provide the sensed temperature to the temperature context awareness unit 210 at step S820. Then, the temperature context awareness unit 210 may generate first load responsive operation information according to the sensed temperature at step S830. Then, the temperature context awareness recognition unit 210 may provide the generated first load responsive operation information to the temperature control unit 220 at step S840, and the temperature control unit 220 may perform a load responsive operation according to the first load responsive operation information at step S850.

Figure 9:
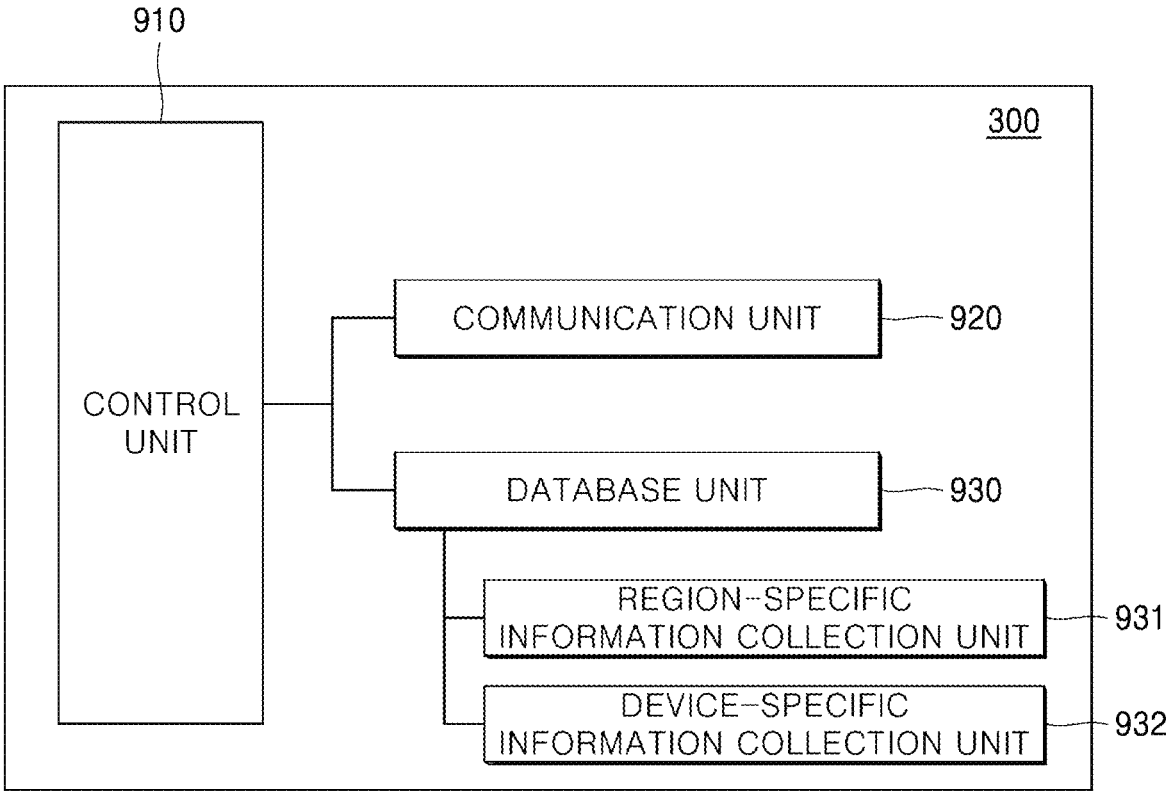
FIG. 9 is a view showing a configuration of a server according to one embodiment of the present invention.

FIG. 9 is a view showing a configuration of a server according to one embodiment of the present invention. The server 300 may include a communication unit 920 for communicating with the communication unit of the refrigerator and the portable device, a database unit 930 for storing information related to a load responsive operation, and a control unit 910 for controlling them.

More specifically, as shown in FIG. 3, the communication unit 920 may receive a load responsive operation flag instructing a load responsive operation from the communication unit of the refrigerator. At this time, the load responsive operation flag may include temperature information at which a load responsive operation is started, information on a storage space, a setup temperature that is set for the storage space, and a model and identification information of the refrigerator. The control unit 910 may store some or all of the information received by the communication unit in the database unit 930.

The communication unit 920 may transmit a message notifying the load responsive operation of the refrigerator to the portable device corresponding to the refrigerator. The portable device corresponding to the refrigerator may extract information of the portable device stored in the database unit 930 through the identification information provided by the refrigerator. Here, the message may include any one or more of current condition information of the load responsive operation, history information, setup information of the refrigerator to be changed according to the load responsive operation, and carry-in condition information including a temperature condition of a material carried into the refrigerator. Such a message may be calculated by the control unit 910 by using the information stored in the database unit 930.

The current condition information or history information may be generated by collecting a result of the refrigerator performing a load responsive operation. The setup information of the refrigerator to be changed according to the load responsive operation may be information instructing whether a setup temperature, i.e., a control temperature should be lowered or increased in comparison to temperatures of materials carried into the refrigerator. This is because, when a load responsive operation frequently occurs, adjusting the setup temperature for the storage space of the refrigerator may prevent power waste.

The carry-in condition information including a temperature condition of a material carried into the refrigerator may be a suggestion to the user about carrying the high-temperature material into the refrigerator after cooling it down, by monitoring a condition in which a high-temperature material is frequently carried into the refrigerator.

In order for the control unit 910 to calculate the information to be included in the above-described message, it is possible to maintain the database unit 930 in a more stratified manner. A region-specific information collection unit 931 may collects information on a load responsive operation of a specific region, and a device-specific information collection unit 932 may collect information on a load responsive operation of a refrigerator with a specific model. This is to enable the control unit 910 to generate load responsive operation logic that is specialized for each region or each device. In addition, the logic calculated from the specific model may be applied to another refrigerator with the same model, so that an operation algorithm that may be provided by the refrigerator may be diversified.

Figure 10:
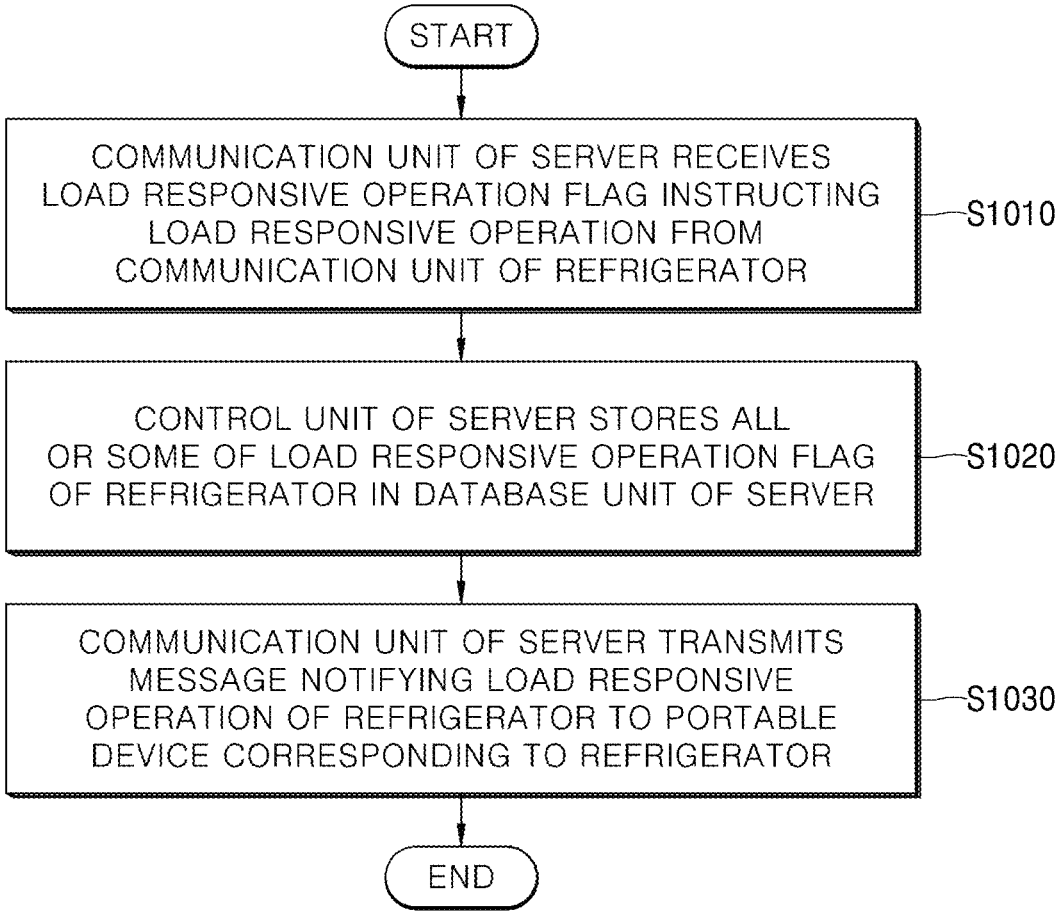
FIG. 10 is a view showing a process in which a server controls a refrigerator according to one embodiment of the present invention.

FIG. 10 is a view showing a process in which a server controls a refrigerator according to one embodiment of the present invention. The entire process may be performed by the components of the server shown in FIG. 9.

When the communication unit of the server receives a load responsive operation flag instructing a load responsive operation from the communication unit of the refrigerator at step S1010, the control unit of the server may store all or some of the load responsive operation flag of the refrigerator in the database unit of the server at step S1020. Then, the communication unit of the server may transmit a message notifying the load responsive operation of the refrigerator to the portable device corresponding to the refrigerator at step S1030. This configuration may be the same as the process shown in FIG. 3.

More specifically, the above-described message may include any one or more of current condition information of a load responsive operation, history information, setup information of the refrigerator to be changed according to the load responsive operation, and carry-in condition information including a temperature condition of a material carried into the refrigerator. It has been described above that such a message may be calculated by the control unit 910 by using information stored in the database unit 930.

Further, the control unit of the server may change the load responsive logic. That is, the control unit of the server may generate load responsive operation logic by using some or all of a plurality of load responsive operation flags that are generated by a plurality of refrigerators and stored in the database unit of the server, and the communication unit of the server may transmit the generated load responsive operation logic to the communication unit of the refrigerator. Here, the load responsive operation logic may include any one or more of time information, temperature information, and humidity information required for the refrigerator to determine the load responsive operation. The load responsive operation logic may be stored by the temperature context awareness unit 210 of the refrigerator, and then the temperature context awareness unit 210 may determine whether to perform the load responsive operation according to the sensed condition or may finely adjust the load responsive operation.

Further, the control unit 910 of the server may generate load responsive operation logic and configure the load responsive operation logic differently according to a region where the refrigerator is installed or a model of the refrigerator by using the region-specific information collection unit 931 and the device-specific information collection unit 932.

In addition, the communication unit 920 of the server may receive identification information of the refrigerator and control information related to the load responsive operation of the refrigerator corresponding to the identification information from the portable device, and then may transmit the received control information related to the load responsive operation to the communication unit of the refrigerator, so that the control information on an on/off state, an operation condition or the like of the load responsive operation of the refrigerator may be generated from the outside to control the refrigerator.

In particular, when the portable device receives a condition of the refrigerator in which the refrigerator frequently performs a load responsive operation through a history file or a real time message and displays the condition of the refrigerator as shown in FIG. 7, the portable device may control the refrigerator by using the interface of FIG. 7. For example, it is possible to not only activate (ON) or stop (OFF) the load responsive operation of the refrigerator but also to adjust conditions of the load responsive operation.

In FIGS. 3, 9 and 10, the server and the portable device may be separated from each other and transmit/receive information from/to each other, but the portable device may communicate directly with the refrigerator, and may also generate or modify the load responsive operation logic.

Figure 11:
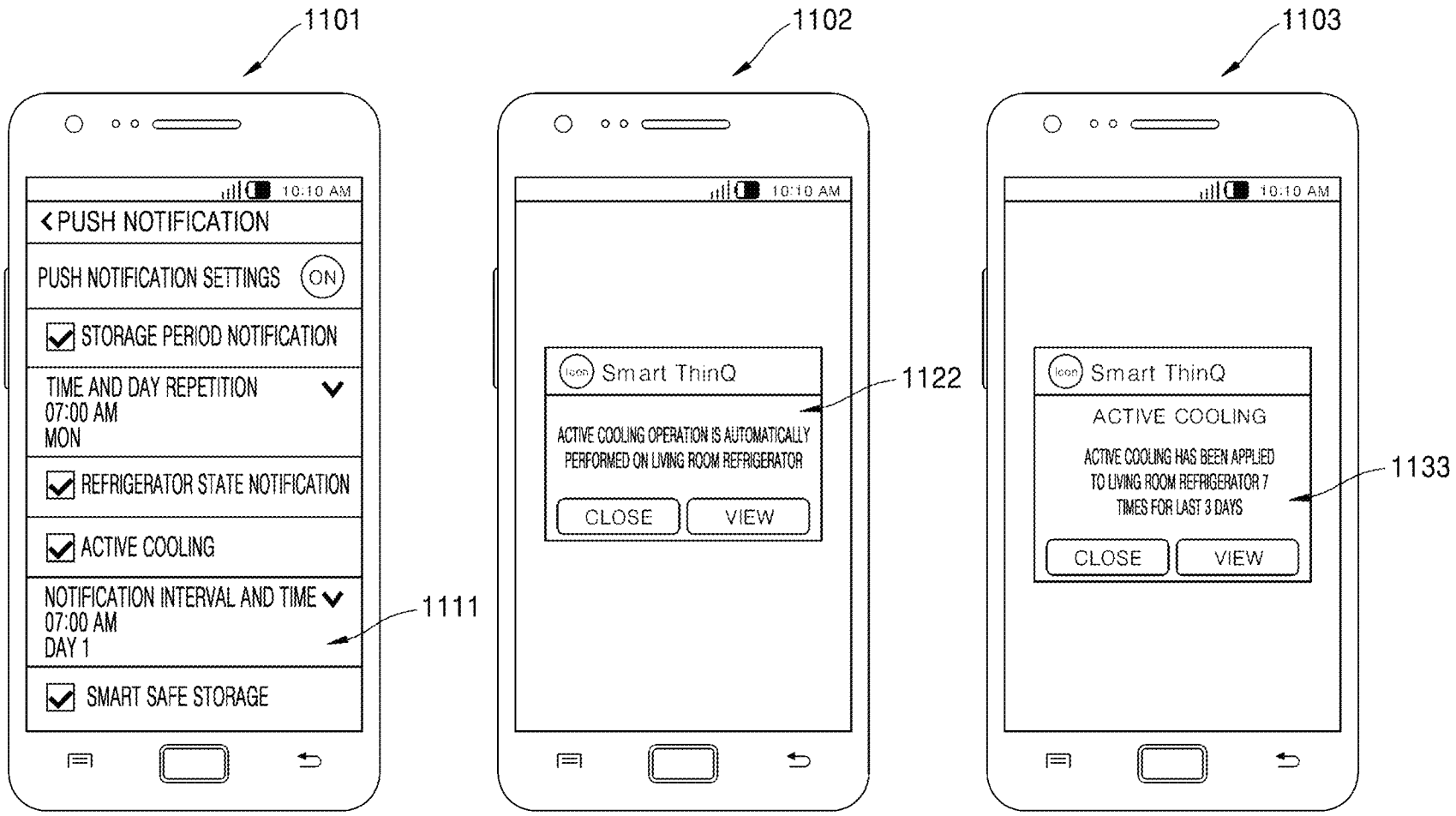
FIG. 11 is a view showing a screen of a portable device for controlling a condition of a refrigerator according to one embodiment of the present invention.

FIG. 11 is a view showing a screen of a portable device for controlling a condition of a refrigerator according to one embodiment of the present invention.

1101 indicates a screen of the portable device for setting a notification interval. With respect to an active cooling item that is one embodiment of a load responsive operation as a detailed item of an application for controlling the refrigerator, a notification interval and time may be set as shown in 1111. The notification interval may be set as a notification interval of once a day, two times a day or more by setting a particular time of a day. Referring to FIG. 3, the portable device 301 may transmit a cycle set by the user to the server 300, as shown in 1101. The server 300 may determine whether to transmit a notification message notifying the load responsive operation of the refrigerator to the portable device 301 in real time or at a predetermined interval (morning/afternoon, 1 day/3 days/7 days, etc.) within a relevant period according to this information. In addition, although not shown in 1101, when there are a plurality of refrigerators, in order to distinguish the refrigerators from each other, a relevant refrigerator may be named "living room refrigerator" as one embodiment of the identification information and stored.

The server 300 may display load responsive operation result on the screen of the portable device 301 after load responsive operation as described in previous embodiment shown in 1102 or 1103.

1102 indicates an embodiment in which the server 300 transmits a notification message notifying a condition of the refrigerator in which the refrigerator performs a load responsive operation in real time, and the notification message is displayed on the screen. Due to a hot food carried into the refrigerator named "living room refrigerator", a pop-up message 1122 indicating that a load responsive operation such as "active cooling" is performed may be displayed.

1103 indicates a pop-up message 1133 displayed when the notification message is not transmitted in real time. When the notification interval is preset as in the above-described 1101, it is possible to display the number of times the refrigerator has performed a load responsive operation such as active cooling during a period corresponding to a relevant notification period. For example, when the notification interval is 3 days, and the number of times the load responsive operation has been performed during the period is 7 times, a pop-up message described as "Active cooling has been applied to the living room refrigerator 7 times for the last 3 days" as shown in 1133.

More specifically, "View" button may be selected in the window 1133 in which the pop-up message is displayed in order to check a load responsive operation condition of the refrigerator.

Figure 12:
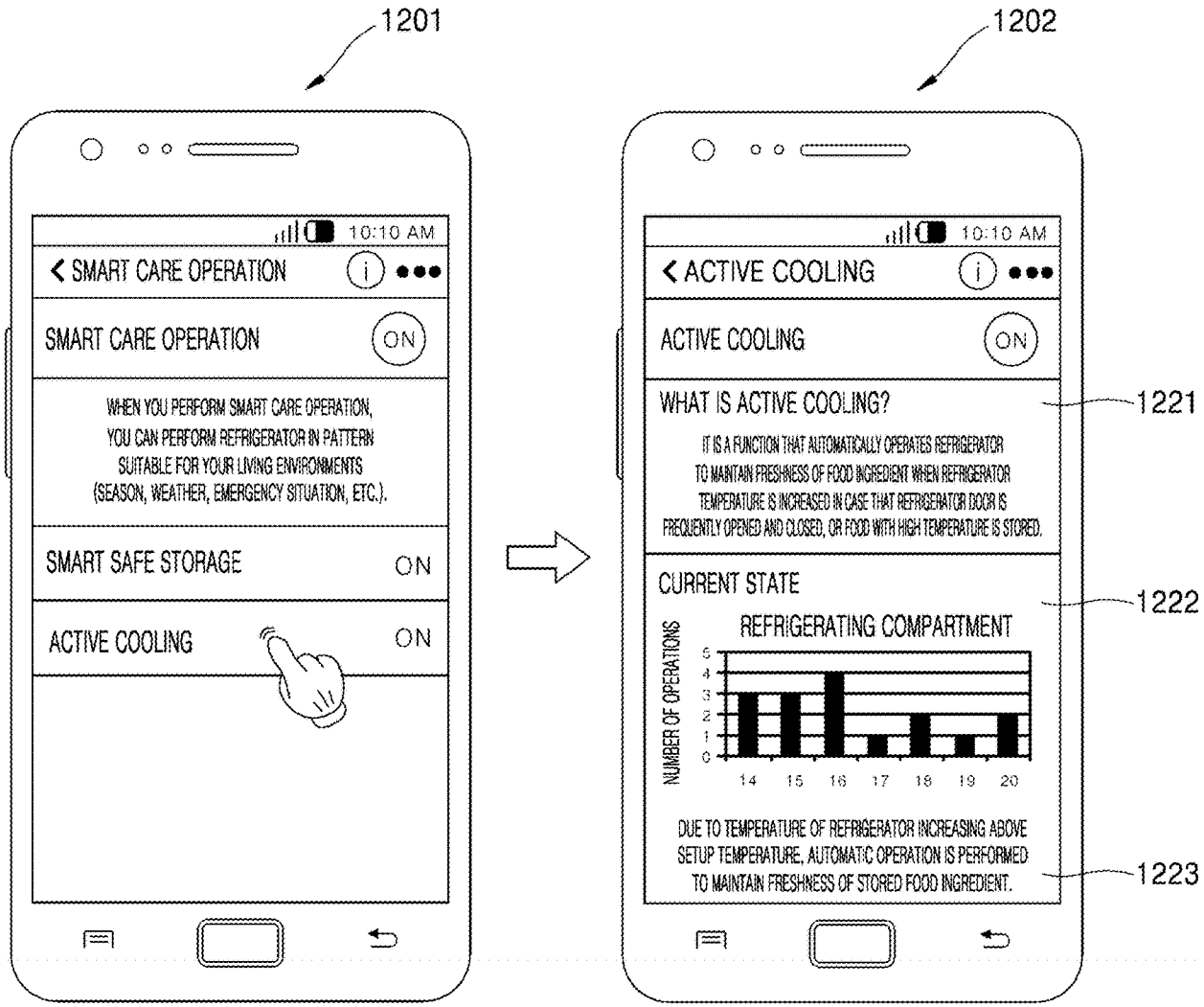
FIG. 12 is a view showing a detailed interface according to one embodiment of the present invention.

FIG. 12 is a view showing a detailed interface according to one embodiment of the present invention.

1201 indicates a screen showing an application described as "Smart Care Operation" that is executed to check detailed items of a load responsive operation such as active cooling when a button described as "View" is selected in the pop-up window shown in 1133 of FIG. 11. The application shows that many items are activated. Here, when the user selects an item described as "Active Cooling", a history of the load responsive operation may be displayed, as shown in 1202. Also, for convenience of the user, a message about the load responsive operation may be output as shown in 1221. In addition, as shown in 1222, a current operation state (automatic operation) of the refrigerator and the number of times the refrigerator has been operated (the number of times of operations) for load response may be displayed by means of a visual image such as a graph.

1223 displays a current state of the refrigerator that is automatically performing a load responsive operation due to an increase in the temperature of the refrigerator through an easy-to-understand message.

Figure 13:
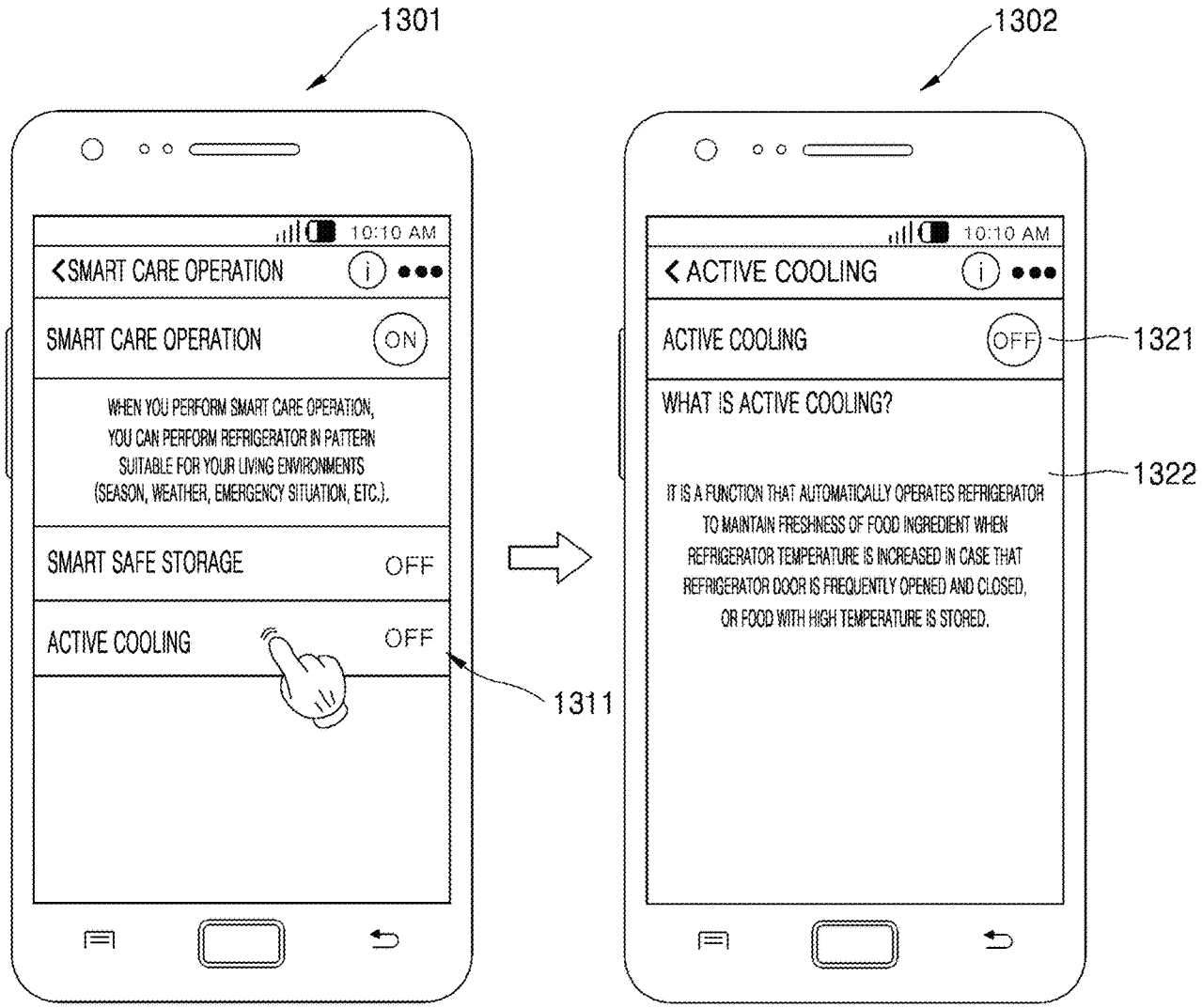
FIG. 13 is a view showing an interface according to another embodiment of the present invention.

FIG. 13 is a view showing an interface according to another embodiment of the present invention. FIG. 13 shows an embodiment in which the user instructs or sets a load responsive operation with the portable device 301 when the load responsive operation is not set. When the user executes an application for controlling the refrigerator, the portable device may display the screen as shown 1301, and currently settable elements may be displayed. Active cooling related to a load response may keep an "OFF" state. When a portion indicated by 1311 is selected to change such a setting to "ON", details related to the active cooling may be displayed as shown in 1302. Here, the user may select a portion indicated by 1321 to change a state of the active cooling to "ON" so that a load responsive operation is automatically performed. In addition, a description may be presented on the screen 1322 so that the user easily checks information on the load responsive operation.

Figure 14:
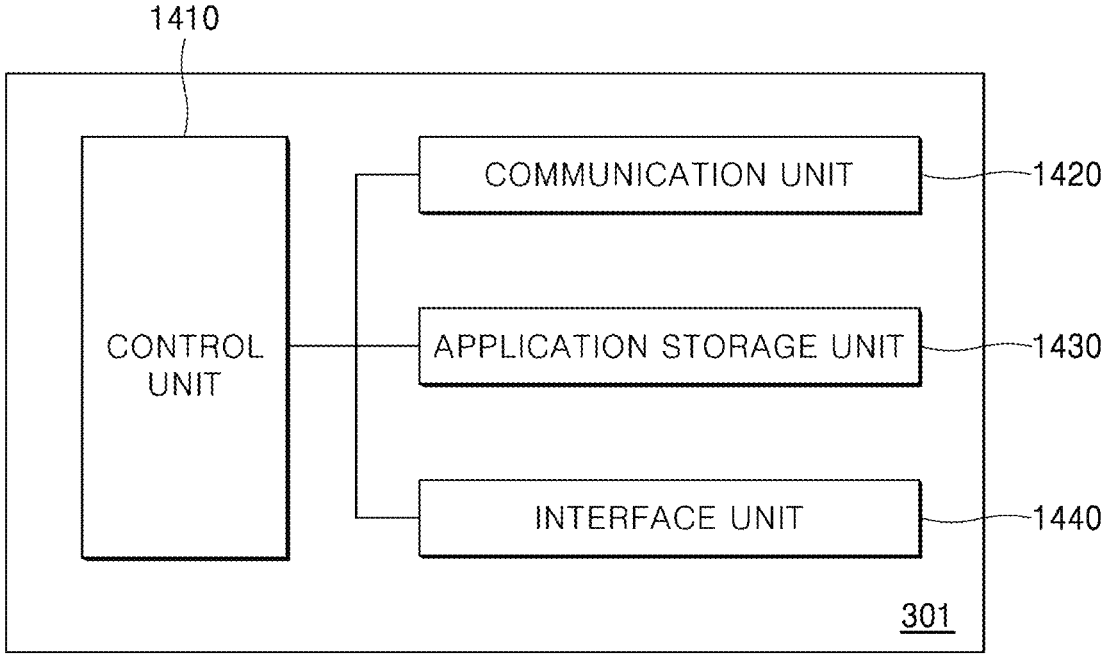
FIG. 14 is a view showing a configuration of a portable device according to one embodiment of the present invention.

FIG. 14 is a view showing a configuration of a portable device according to one embodiment of the present invention. The portable device 301 may include a control unit 1410, a communication unit 1420, an application storage unit 1430, and an interface unit 1440. Of course, the portable device 301 may include various components not shown in FIG. 14 according to characteristics of the portable device 301.

The application storage unit 1430 may store an application for controlling a load responsive operation of the refrigerator. The operation of the above-described application may include various embodiments described with reference to FIGS. 11 to 13. Based on characteristics of the portable device 301, an arrangement of a message and the like in the screen may be determined in various ways according to an application.

The communication unit 1420 may transmit a setup condition that is set by using an application stored in the application storage unit 1430 to the server 300, and may receive a message notifying a load responsive operation of the refrigerator from the server 300. This configuration is same as described above with reference to FIG. 3. The interface unit 1440 may output a screen of the application to allow the user to check a message presented by the application and select a particular function. The control unit 1410 may execute the application and control the communication unit 1420 and the interface unit 1440. A type of the message received by the communication unit 1420 from the server 300 is a message related to a load responsive operation of the refrigerator, and one embodiment thereof may be current condition information of the load responsive operation. The current condition information may include information on whether the refrigerator is currently performing the load responsive operation. As shown in 1102 of FIG. 11, information on the current condition indicating that the load responsive operation is being performed may be an embodiment of the message.

Next, the massage may also include history information on the performed load responsive operation. The history information may include information on how many times the load responsive operation has been performed for a certain period of time, as shown in 1103 of FIG. 11. This information may be displayed as a graph of 1202 and 1222 of FIG. 12.

The above-described message may include any one or more of the setup information of the refrigerator to be changed according to a load responsive operation, and the carry-in condition information including a temperature condition of a material carried into the refrigerator. This message may be generated by the refrigerator or generated by the server by using the history information. When a load responsive operation is excessively performed, a message may be displayed to lower the setup temperature of the refrigerator or to set a power operation time point, thereby providing the user with a setup condition that allows the refrigerator to operate more efficiently. In addition, when a hot food is repeatedly carried into the refrigerator, it is possible to provide a caution to be taken when carrying something into the refrigerator to the user through a message, reflecting an electricity use or a cooling efficiency aspect. For example, a message related to the user's refrigerator usage pattern such as "Please bring a food of 70 degrees or more into the refrigerator after cooling it down for 20 minutes".

The interface unit 1440 may display a message received by the communication unit 1420 in a pop-up form on the screen. The interface unit 1440 display any one or more of the above-described current condition information, history information, history information, setup information or the carry-in condition information on the screen according to an input signal for touching the screen or performing a screen switch.

In the embodiment of this application in which the portable device 301 is a smart phone, a communication method with the refrigerator 100 may include a wireless LAN method using Wi-Fi or mobile communication such as 4 G/5 G using long term evolution-advanced (LTE-A).

Although the above-described embodiments are mainly focused on the case where a high-temperature material is carried into the refrigerator, the present invention is not limited thereto. For example, if a temperature of a material carried in the storage space is too low to sufficiently decrease the internal temperature of the storage space, the cooling or freezing for the storage space may be temporarily stopped or weakened. This operation may also be performed by the temperature-context-aware refrigerator 100 of FIG. 2. For example, one of the temperature sensors 201 may sense a temperature of a particular storage space and verify that temperature is too low as a result of sensing. The temperature context awareness unit 210 may use the first temperature information set for the storage space and second temperature information sensed by the temperature sensor 201 to generate load responsive operation information including a target temperature higher than the first temperature of the first temperature information. For example, when a very cold material is carried into the storage space of which temperature is set to 2 degrees, and the internal temperature of the storage space becomes −3 degrees accordingly, the temperature context awareness unit 210 may generate load responsive operation information for weakening cooling by setting the target temperature to 4 degrees. Accordingly, the temperature control unit 220 may perform a load responsive operation by using the above-described load responsive operation information so as to control the temperature of the storage space, that is, to increase the temperature of the storage space. Here, the load responsive operation information may instruct to temporarily stop cooling or freezing of the storage space or weaken cooling or freezing of the storage space, as described above.

In summary, the present invention relates to a temperature-context-aware refrigerator and a method of controlling the same. The temperature-context-aware refrigerator according to one embodiment of the present invention may include the temperature context awareness unit for sensing temperatures of one or more partitioned storage spaces and generating load responsive operation information including a target temperature lower than or higher than a temperature set for a relevant storage space when a difference between the sensed temperature and the set temperature is equal to or greater than a predetermined magnitude, and the temperature control unit for controlling the temperature sensor and the temperature context awareness unit and performing a load responsive operation by using the above-described load responsive operation information so as to control the temperature of the storage space. The refrigerator may selectively include the database unit required for the temperature context awareness unit to generate the load responsive operation information. Also, a temperature-context-aware operation of the refrigerator may be stored in the server as a history, and may be transmitted to the portable device.

According to the present invention, when a high-load food, which is difficult to control within a first temperature range that is set, is sensed, a load responsive operation may be performed by changing a setup temperature to be within a second temperature range in a temperature context-aware manner. In particular, in order to prevent an interior of the storage space from being super cooled due to the load responsive operation for the high-load food, it is possible to determine whether to return to driving according to settings of the original first temperature range by continuously sensing in the middle of the load responsive operation. Also, when s load responsive operation frequently occurs as a result of responding in a temperature context-aware manner, a message notifying that the entire setup temperature is decreased may be output through the portable device or the refrigerator. In addition, when a load responsive operation of the refrigerator occurs or the load responsive operation frequently occurs as a result of monitoring the load responsive operation, it is possible to output a message indicating that a material should be carried in after cooling it down through a smart phone that is a portable device or a refrigerator display.

Even if it was described above that all of the components of an embodiment of the present invention are coupled as a single unit or coupled to be operated as a single unit, the present invention is not necessarily limited to such an embodiment. That is, among the components, one or more components may be selectively coupled to be operated as one or more units. In addition, although each of the components may be implemented as an independent hardware, some or all of the components may be selectively combined with each other, so that they can be implemented as a computer program having one or more program modules for executing some or all of the functions combined in one or more hardwares. Codes and code segments forming the computer program can be easily conceived by a person skilled in the technical field of the present invention. Such a computer program may implement the embodiments of the present invention by being stored in a computer readable storage medium, and being read and executed by a computer. A magnetic recording medium, an optical recording medium, a carrier wave medium, or the like may be employed as the storage medium. Also, a computer program to implement an embodiment of the present invention may include a program module that is transmitted in real time via an external device.

The present invention is described with reference to embodiments described herein and accompanying drawings, but is not limited thereto. It should be apparent to those skilled in the art that various changes or modifications which are not exemplified herein but are still within the spirit and scope of the present disclosure may be made.

DESCRIPTION OF SYMBOLS

100: Refrigerator
110: Display unit (or display)
201, 202, . . . , 209: Temperature sensor (or first sensor)
210: Temperature context awareness unit
215: Door sensing unit (or door sensor or second sensor)
220: Temperature control unit
230: Communication unit (or communication interface)
240: Database unit (or memory)
290: Interface unit (or user interface)
300: Server (or computer)
301: Portable device (or user device)
910: Control unit (or computer controller)
920: Communication unit (or computer communication interface)
930: Database unit (or computer memory)
1410: Control unit (or user device controller)
1420: Communication unit (or user device communication interface)
1430: Application storage unit (or user device memory)
1440: Interface storage unit (or user device user interface)

The invention claimed is:

1. A refrigerator, comprising:
a first storage space;
one or more temperature sensors to detect a temperature of the first storage space;
a controller to:
generate first operation information identifying a second target temperature lower than a first target temperature set for the first storage space, the first operation information being generated based on the first target temperature and first temperature information detected by the one or more temperature sensors, and
perform a load responsive operation that includes controlling a temperature of the first storage space based on the first operation information; and
a communication interface to exchange data with a user device,
wherein the user device includes:
a user device memory to store an application that controls the load responsive operation of the refrigerator;
a user device communication interface to transmit a setup condition set generated by the application to a computer and to receive a notification message related to the load responsive operation of the refrigerator from the computer;
a user device user interface to output data associated with the application; and
a user device controller to execute the application and control the user device communication interface and the user device user interface, and
wherein the notification message includes one or more of current condition information of the load responsive operation of the refrigerator, history information related to operation of the refrigerator, setup information of the refrigerator to be changed according to the load responsive operation, or carry-in condition information including a temperature condition of an object positioned in the refrigerator.

2. The refrigerator of claim 1,
wherein, while the controller performs the load responsive operation based on the first operation information, the one or more temperature sensors further detect second temperature information identifying a temperature of the first storage space at a preset interval, and
wherein controller further determines whether to stop the load responsive operation based on the second temperature information detected by the one or more temperature sensors.

3. The refrigerator of claim 1, further comprising:
a user interface that displays an operation condition according to the first operation information, the operation condition identifying the second target temperature.

4. The refrigerator of claim 1, wherein the communication interface further transmits at least a portion of the first temperature information to an external device, and receives logic to generate the first operation information from the external device.

5. The refrigerator of claim 1, further comprising:
a door sensor to detect whether of a door of the refrigerator is opening or closing the first storage space,
wherein the controller further determines whether to perform the load responsive operation according to opening or closing of the first storage space by the door.

6. The refrigerator of claim 5,
wherein the controller generates the first operation information when the first temperature information detected by the one or more temperature sensors indicates a change in a temperature of the first storage area within a particular period of time after the first storage space is opened and closed by the door.

7. The refrigerator of claim 1,
wherein the one or more temperature sensors further detect at least one of a temperature of an object positioned in the first storage space or a humidity in the first storage space, and
wherein the first operation information is further generated based on the at least one of the temperature of the object or the humidity in the first storage space.

8. The refrigerator of claim 1, further comprising a second storage space that is separate from the first storage space,
wherein, the controller further generates second operation information for the second storage space while performing the load responsive operation according to the first operation information, and performs a second load responsive operation based on the second operation information.

9. The refrigerator of claim 1,
wherein the user device user interface displays a message received via the user device communication interface on a screen in a pop-up form, and
wherein the user device user interface further displays at least one of the current condition information, the history information, the setup information, or the carry-in condition information on the screen.

10. A refrigerator comprising:

a first storage space;

one or more temperature sensors to detect a temperature of the first storage space;

a controller to:

generate first operation information identifying a second target temperature lower than a first target temperature set for the first storage space, the first operation information being generated based on the first target temperature and first temperature information detected by the one or more temperature sensors; and perform a load responsive operation that includes controlling a temperature of the first storage space based on the first operation information; and a communication interface to exchange data with a computer, wherein the computer includes:

a computer communication interface to communicate with the refrigerator and a user device;

a computer memory to store information related to the load responsive operation; and a computer controller that manages the computer communication interface and the computer memory to control the refrigerator in a context-aware manner, wherein:

the computer communication interface receives a load responsive operation flag message related to the load responsive operation from the communication interface of the refrigerator, the computer memory stores at least a portion of the load responsive operation flag message, and the computer communication interface transmits a notification message notifying the user device of the load responsive operation of the refrigerator, and wherein the notification message includes one or more of current condition information of the load responsive operation, history information related to operation of the refrigerator, setup information of the refrigerator to be changed according to the load responsive operation, or carry-in condition information including a temperature condition of an object positioned in the refrigerator.

11. The refrigerator of claim 10, wherein:

the computer controller generates load responsive operation logic using one or more of a plurality of load responsive operation flag massages generated by a plurality of refrigerators, the computer communication interface transmits the load responsive operation logic to the communication interface of the refrigerator, and the load responsive operation logic includes one or more of time information, temperature information, or humidity information used by the refrigerator to determine the load responsive operation.

12. The refrigerator of claim 11, wherein the load responsive operation logic is configured differently according to at least one of a region where the refrigerator is installed or a model of the refrigerator.

13. The refrigerator of claim 10, wherein the computer further:

receives identification information of the refrigerator and control information related to the load responsive operation corresponding to identification information from the user device, and transmits the received control information related to the load responsive operation to the communication interface of the refrigerator.

* * * * *